US008406646B2

(12) United States Patent
Kamijo et al.

(10) Patent No.: US 8,406,646 B2
(45) Date of Patent: Mar. 26, 2013

(54) IMAGE FORMING APPARATUS AND IMAGE FORMING METHOD

(75) Inventors: Koichi Kamijo, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 387 days.

(21) Appl. No.: 12/815,987

(22) Filed: Jun. 15, 2010

(65) Prior Publication Data

US 2011/0008079 A1 Jan. 13, 2011

(30) Foreign Application Priority Data

Jul. 7, 2009 (JP) ..... 2009-160668

(51) Int. Cl.
*G03G 15/00* (2006.01)
*G03G 15/16* (2006.01)

(52) U.S. Cl. ..... 399/66; 399/167; 399/303; 399/304

(58) Field of Classification Search ..... 399/304, 399/302, 303, 308, 66, 75, 167
See application file for complete search history.

(56) References Cited

U.S. PATENT DOCUMENTS 4,390,176 A 6/1983 Kato
4,935,778 A * 6/1990 Mochida ..... 399/167
6,163,676 A 12/2000 Levanon et al.

FOREIGN PATENT DOCUMENTS

JP 57-186764 A 11/1982
JP 63-177183 A * 7/1988
JP 04-337755 A * 11/1992
JP 05-127468 A * 5/1993
JP 2000-508280 A 7/2000
JP 2009-36943 A 2/2009
WO WO-97/09262 A1 3/1997

OTHER PUBLICATIONS

Extended European Search Report dated Oct. 21, 2010 for the corresponding European Patent Application No. 10168604.6.

* cited by examiner

*Primary Examiner* — Sophia S Chen
(74) *Attorney, Agent, or Firm* — Global IP Counselors, LLP

(57) ABSTRACT

An image forming apparatus includes an image carrier, a transfer roller, a transfer roller position detector and a controller. The transfer roller includes a concaved portion formed on a circumferential surface thereof with the concaved portion having a width in the circumferential direction larger than a width of a transfer nip formation area formed between the image carrier and the transfer roller in the circumferential direction. The transfer roller includes an elastic member disposed on the circumferential surface thereof. The transfer roller position detector is configured and arranged to detect a rotational position of the transfer roller. The controller is configured to stop rotation of the transfer roller in a state in which the concaved portion is located at the transfer nip formation area on the basis of the rotational position of the transfer roller.

8 Claims, 17 Drawing Sheets

IMAGE FORMING APPARATUS AND IMAGE FORMING METHOD

CROSS-REFERENCE TO RELATED APPLICATIONS

This application claims priority to Japanese Patent Application No. 2009-160668 filed on Jul. 7, 2009. The entire disclosure of Japanese Patent Application No. 2009-160668 is hereby incorporated herein by reference.

BACKGROUND

1. Technical Field

The present invention relates to an electro photographic type image forming apparatus and an image forming method to transfer a toner image onto access transfer material such as paper, and to form an image onto the transfer material using a transfer roller having an elastic member on its circumferential surface.

2. Related Art

In the related art, as an electro photographic type image forming apparatus, the image forming apparatus is suggested in which a transfer material gripping member is installed on a transfer roller, and a leading edge of the transfer material is pinched by the gripping member and transfers the toner image of the image carrier to the transfer material such as paper (for example, refer to JP-A-2000-508280). With the image forming apparatus, it is possible to reliably separate the transfer material from the image carrier after the transferring operation completed.

Additionally, another image forming apparatus is suggested in which a transfer roller having an elastic member on the surface thereof presses onto the image carrier to form a transfer nip, and a toner image of the image carrier is transferred onto the transfer material by applying a transfer bias to the transfer roller (for example, JP-A-2009-36943).

SUMMARY

In the image forming apparatus described in JP-A-2009-36943, the transfer roller press-contacts the image carrier constantly. Therefore, the long-term pressure between the transfer roller and the image carrier causes the elastic member of the transfer roller to be deformed. When the elastic member of the transfer roller is deformed, banding or defects in the image are caused in the deformed portion, and the quality of the image is degraded.

An advantage of some aspects of the invention is to provide the image forming apparatus and the image forming method capable of performing a better image transfer and reliably separating the transfer material from the transfer roller.

According to one aspect of invention, there is provided an image forming apparatus and the image forming method. An elastic member is installed in the circumferential surface of the transfer roller having a concaved portion, along with which a transfer nip formation area is formed where the transfer roller is pressed against the image carrier when the image is transferred. In this case, the width of the concaved portion is larger than the width of the transfer nip formation area in the circumferential direction of the transfer roller. The transfer roller is stopped when the concaved portion is in the transfer nip formation area, so as not to have contact between the transfer roller and the image carrier when the image is not transferred. Thus, the transfer nip is not formed in the transfer nip formation area between the transfer roller and the image carrier when the image forming operation of the image forming apparatus is not performed. Accordingly, the elastic member of the transfer roller is not twisted, even when the image forming apparatus is not operated for a long time. Thus, the image defect and the occurrence of the banding caused by the twisting of the elastic member are suppressed effectively and a higher quality image can be obtained.

BRIEF DESCRIPTION OF THE DRAWINGS

Referring now to the attached drawings which form a part of this original disclosure.

DESCRIPTION OF EXEMPLARY EMBODIMENTS

The present invention will now be described in terms of the explanatory embodiment with reference to the accompanying drawings.

Figure 1:
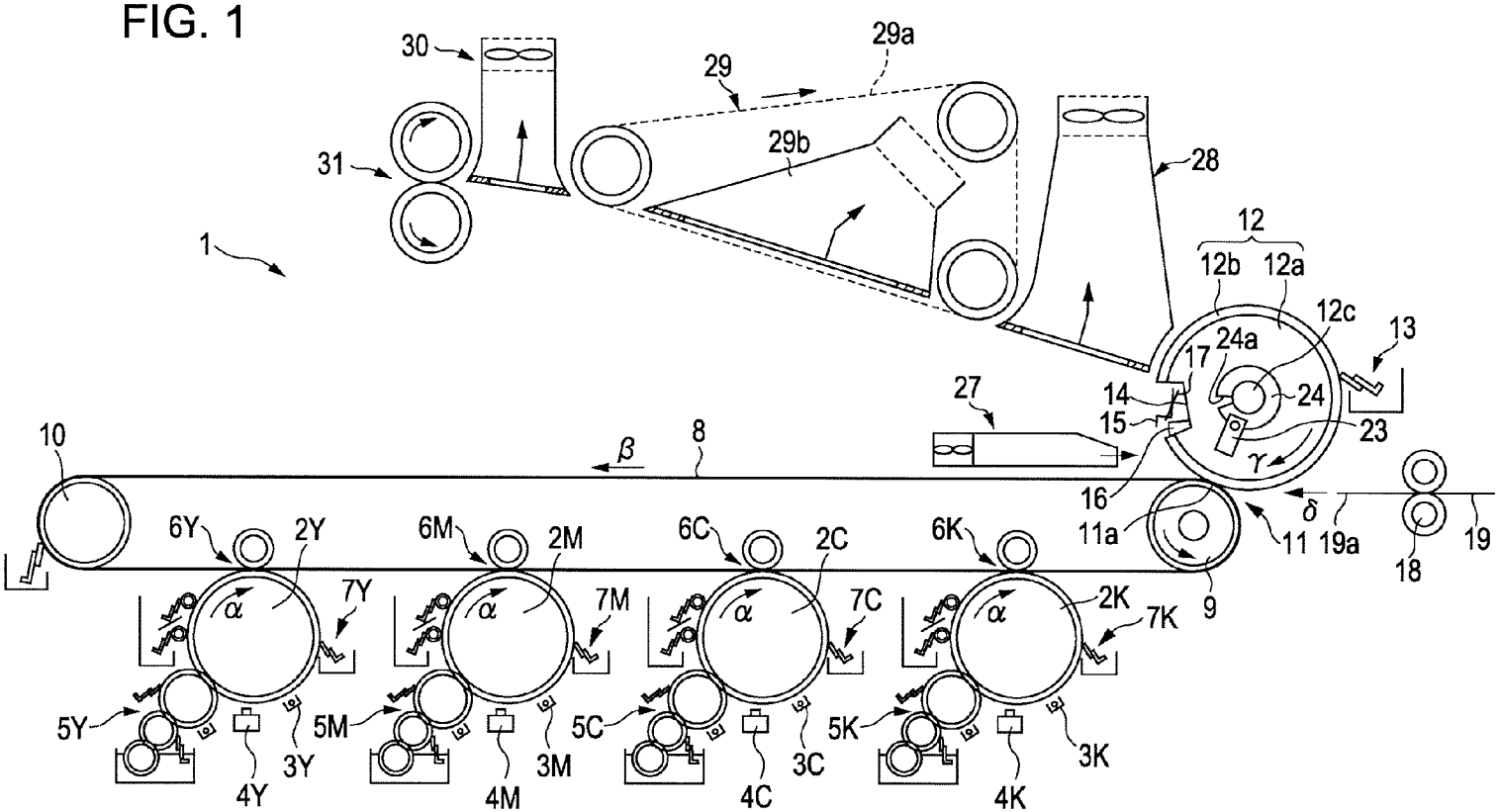
FIG. 1 is a schematic partial diagram showing the image forming apparatus according to the first embodiment of the invention.

FIG. 1 is a schematic and partial diagram showing the image forming apparatus according to the first embodiment of the invention.

The image forming apparatus 1 of the first embodiment forms an image using a liquid developer including toner particles and transfer liquid. As shown in FIG. 1, the image forming apparatus 1 includes photosensitive bodies 2Y, 2M, 2C and 2K arranged horizontally, or in tandem nearly horizontally. Here, 2Y is a yellow photosensitive body, 2M is a magenta photosensitive body, 2C is a cyan photosensitive body and 2K is a black photosensitive body. As used herein, other parts of the image forming apparatus are provided with the letters Y, M, C and K at the end of reference numbers to respectively indicate the corresponding colors of yellow, magenta, cyan and black.

Each of the charging sections 3Y, 3M, 3C and 3K is installed around the photosensitive bodies 2Y, 2M, 2C and 2K, respectively. Exposure sections 4Y, 4M, 4C and 4K which are the image writing sections, developing sections 5Y, 5M, 5C and 5K, first transfer sections 6Y, 6M, 6C and 6K, and the photosensitive bodies cleaning sections 7Y, 7M, 7C and 7K are installed in this order in the rotational direction α of the photosensitive bodies 2Y, 2M, 2C and 2K from each of the charging sections 3Y, 3M, 3C and 3K.

Also, the image forming apparatus 1 includes a transfer belt, more specifically, an endless shaped intermediate transfer belt 8. The intermediate transfer belt 8 preferably constitutes an image carrier of the first embodiment. The intermediate transfer belt 8 is positioned above each of the photosensitive bodies 2Y, 2M, 2C and 2K. The intermediate transfer belt 8 is press-contacted to each of the photosensitive bodies 2Y, 2M, 2C and 2K with a first transfer section 6Y, 6M, 6C and 6K, respectively.

Although it is not shown in the drawings, the intermediate transfer belt 8 is preferably formed by 3 layered structure which is made by a relatively soft elastic belt, including a flexible substrate for example resin, an elastic layer, for example, rubber layer, formed on the surface of the substrate, and an outer layer formed on the surface of the elastic layer. As an embodiment of the intermediate transfer belt 8, for example, the intermediate transfer belt disclosed in JP-A-2009-36943 can be employed. The description of the intermediate transfer belt described in JP-A-2009-36943 is omitted because the intermediate transfer belt can be understood from the description therein. Of course, the intermediate transfer belt 8 is not limited to the belt described in JP-A-2009-36943. The intermediate transfer belt 8 is located tightly between the intermediate transfer belt driving roller 9 and the intermediate transfer belt tension roller 10. The intermediate transfer belt driving roller 9 is driven by the intermediate transfer belt driving motor (not shown). The intermediate transfer belt 8 is rotated in a rotational moving direction β, in a tensioned state.

Also, the location order of the photosensitive bodies corresponding to each of the colors Y, M, C and K is not limited to FIG. 1 and may be arranged arbitrarily.

A second transfer section 11 which is a transfer apparatus, is installed on the intermediate transfer belt driving roller 9 side of the intermediate transfer belt 8. The second transfer section 11 includes a second transfer roller 12 and a second transfer cleaning section 13.

Figure 2A:
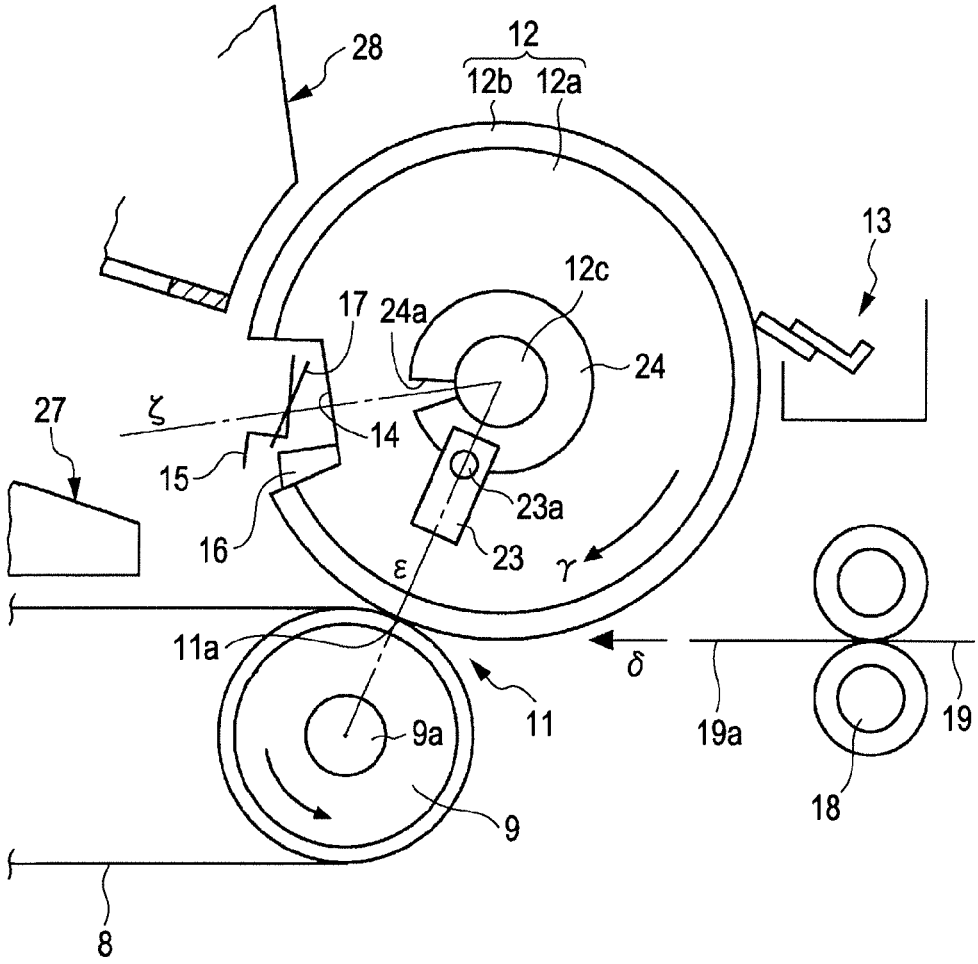
FIG. 2A is a partial enlarged view showing the second transfer section according to the first embodiment.

As shown in FIG. 1 and FIG. 2A, the second transfer roller 12 includes a substrate having a concaved portion 14 which is formed on the peripheral (circumferential) surface of the substrate 12*a* and extending to the axial direction of second transfer roller 12. The second transfer roller 12 further includes an elastic member 12*b* which is formed with a sheet type elastic layer, for example, rubber which is wound on the peripheral surface of a circular section of the substrate 12*a*, except for the concaved portion 14. In this case, both ends of the elastic member 12*b* are fixed on the side walls of the concaved portion 14 though it is not shown in the drawings. Also, the length of the elastic member 12*b* which is located on the circular shaped outer peripheral surface of the second transfer roller 12 as measured in a circumferential direction of the transfer roller 12 is set to be longer than a maximum size of a transfer material 19 used in the image forming apparatus 1 as measured in a moving direction of the transfer material 19. A resist layer is formed with the elastic member 12*b* on the peripheral surface of the circular section of the second transfer roller 12. As the elastic member 12*b*, an elastic material which is used in an elastic layer known in the related art such as the intermediate transfer belt of the image forming apparatus, can be used (for example, the elastic layer such as urethane of the intermediate transfer belt 8 as described in JP-A-2009-36943).

Further, the elastic member 12*b* of the second transfer roller 12 is press-contacted to the intermediate transfer belt 8 by bias force of a bias member like spring, not shown in the drawings. Accordingly, the second transfer nip 11*a* is formed in a transfer nip formation area between the intermediate transfer belt 8 and the elastic member 12*b* of the second transfer roller 12, as shown in FIG. 1. At this time, the intermediate transfer belt driving roller 9 functions as a backup roller against the pressure of the second transfer roller 12.

Figure 2B:
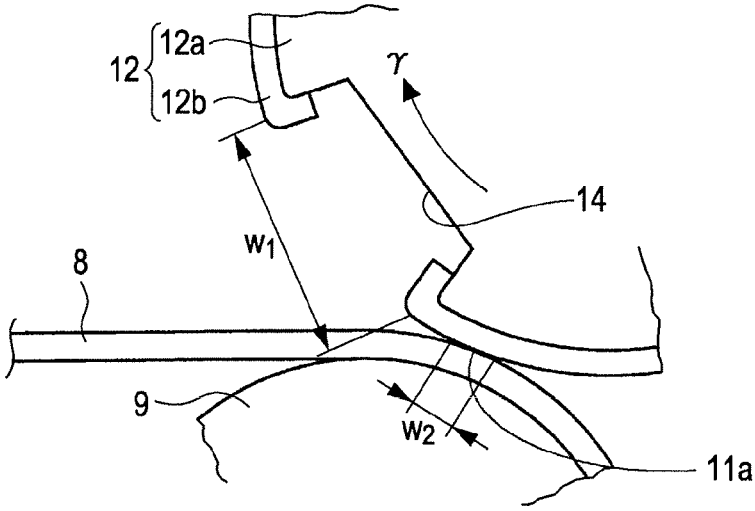
FIG. 2B is an explanatory view showing the relation between the width of the second transfer nip formation area and the width of the concaved portion.

As shown in FIG. 2B, a straight width $w_1$ of the concaved portion 14 in the peripheral (circumferential) direction of the second transfer roller (the transfer material 19 moving direction on the second transfer nip 11*a* position) is set wider than width $w_2$ in the same direction of the transfer nip formation area where the second transfer nip 11*a* is formed ($w_1>w_2$). Hereinafter, a measurement method of the nip width $w_2$ will be described. First of all, two liquid curable silicon rubbers for the template are coated on the portion where the nip is formed for the measurement of the second transfer roller 12. Next, the two liquid curable silicon rubbers of the second transfer roller 12 are pressed to the belt driving roller 9 of the second transfer roller 12 with a constant pressure, which forms a concaved portion with the two liquid curable silicon rubbers. As the two liquid curable silicon rubbers, EXAFINE (injection type; available from GC Corporation) can be used in this embodiment. Further, after curing the two liquid curable silicon rubbers, the width of the nip forming section which is the thin film portion of the concaved portion is measured using the vernier calipers. The width of the measured nip forming section is the nip width $w_2$.

Further, the transfer bias is applied to the second transfer roller 12. During the image forming operation, the second transfer roller 12 is rotated in the rotational direction β, and at the same time the transfer bias is applied when the second transfer roller 12 is moved to the moving direction β of the intermediate transfer belt 8, so that the toner image which is transferred to the intermediate transfer belt 8 with the transfer nip 11*a* is transferred to the transfer material like paper.

The gripper 15 which is a gripping member to pinch the transfer material, the gripper support member 16 which is an access receiving member receiving the gripper and seated by the gripper 15, and a separating click 17 which is a member for separating the transfer material, are installed in the concaved portion 14. Although not shown in the drawings, the gripper 15 is installed in a predetermined number along the axial direction of the second transfer roller 12, and each gripper 15 is formed in a shape of the teeth of a comb. Also, the gripper support member 16 is installed on the corresponding position of each gripper 15 and the separating click 17 is installed between the comb teeth, and at the outside of the comb teeth, which is located at both ends of the gripper 15.

Further, the image forming apparatus 1 has a gate roller 18 which transports the transfer material toward the second transfer nip 11*a*. Also, the gate roller 18 supplies the transfer material 19 to the second transfer nip 11*a* at such a timing that the toner image which is transported by the second transfer belt 8 is secondarily transferred at the second transfer section 11.

The gripper 15 is rotated toward the gripper support member 16 just before the concaved portion 14 reaches to the second transfer nip 11*a*, so that the gripper 15 pinches the leading edge 19*a* of the transfer material 19, which is transported toward the direction of the transportation direction δ from the gate roller 18, with the gripper support member 16. In the state in which the gripper 15 pinches the leading edge 19*a* of the transfer material 19, the toner image which is carried on the intermediate transfer belt 8, is transferred onto the transfer material 19 at the second transfer nip 11*a*. Further, in the state in which the gripper 15 pinches the leading edge 19*a* of the transfer material 19, the transfer material 19 which is passed through the second transfer nip 11*a*, is reliably separated from the intermediate transfer belt 8 forming the second transfer nip 11*a*. Then, the leading edge 19*a* of the transfer material 19 is released rotating toward the separating direction from the gripper support member 16. Also, before and after the release of the transfer material 19 by the gripper 15, each separating click 17 is projected to its projection position. Accordingly, the back surface of the leading edge of the transfer material 19 (the opposite surface of the toner image transfer surface of the transfer material) is projected from each separating click 17. In this way, the transfer material 19 is separated from the transfer roller 12. Then, each separating click 17 returns within the concaved portion 14. Each operation of the gripper 15 and the separating click 17 is controlled by the gripper control cam and the separating click control cam which are not shown in the drawings, by the rotation of the second transfer roller 12.

Figure 3B:
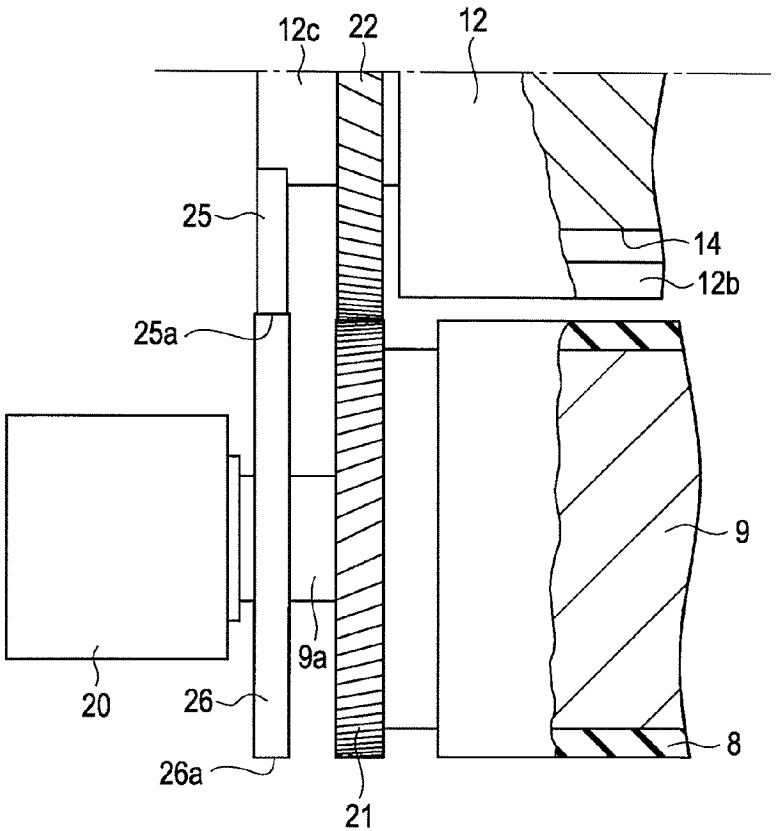
FIG. 3B is an explanatory drawing viewed in a direction indicated by an arrow IIIB of FIG. 3A according to the first embodiment.

As shown in the FIG. 3B, the intermediate transfer belt driving roller 9 and the second transfer roller 12 are rotated by one common intermediate transfer belt/second transfer roller driving motor 20. In other words, the driving force of the intermediate transfer belt/second transfer roller driving motor 20 is delivered to the intermediate transfer belt driving roller 9, so that the intermediate transfer belt driving roller 9 is rotated counterclockwise in an arrow when viewed in a direction shown in FIG. 3A. Further, the driving force of the intermediate transfer belt/second transfer roller driving motor 20 is delivered to the second transfer roller 12 through the intermediate gear 21, which is installed on the shaft 9*a* of the intermediate transfer belt driving roller 9 to be integrally rotatable with the shaft 9*a*, and the second transfer roller driving gear 22, which is installed on shaft 12*c* of the second transfer roller 12 to be integrally rotatable with the shaft 12*c*. Accordingly, the second transfer roller 12 is rotated clockwise in the direction γ when viewed in a direction in FIG. 3A.

As shown in FIG. 1, a photo sensor 23 and a cam 24 for the photo sensor 23 are installed at the end of the second transfer roller 12. The photo sensor 23 is the second transfer roller position detector (corresponding to the transfer roller position detector) for detecting the rotational position of the second transfer roller 12. The cam 24 for photo sensor 23 is located near the photo sensor 23. The cam 24 for the photo sensor 23 has a circular plate having a notch 24*a*, and is integrally installed to the second transfer roller 12 so as to be rotatable with the shaft 12*c* of the second transfer roller 12. Those which are well known in the related art can be used for the photo sensor 23 and the cam 24 for the photo sensor 23. Also, the photo sensor 23 detects the rotational position of the notch 24*a* of the cam 24, so that it detects the position of the second transfer roller 12 to output the second transfer roller position signal (ON signal) having a pulse shape.

In this case, the concaved portion 14 is integrally installed to be rotatable with the second transfer roller 12, so that relative position between the rotational position of the second transfer roller 12 and the rotational position of the concaved portion 14 is not changed, and both rotational positions are determined at once. Accordingly, the second transfer roller position signal which is output by the photo sensor 23 is the signal of the position of the concaved portion 14, and the photo sensor 23 and the cam 24 constitute the position detector of the concaved portion 14 which detects the rotational position of the concaved portion 14. In this case, when the photo sensor 23 outputs one of the second transfer roller position signals (ON signal), the second transfer roller position signal maintains an OFF signal until it newly detects the position of the concaved portion 14 and outputs the next second transfer roller position signals (ON signal).

As shown in FIG. 2A, the center of a notch detector 23*a* of the photo sensor 23 is arranged on the imaginary straight line ϵ which connects the center of the rotational shaft 9*a* of the intermediate transfer belt driving roller 9 to the center of the rotational shaft 12*c* of the second transfer roller 12, so that it is attached on the apparatus body, for example. Also, the circumferential center of the notch 24*a* is arranged on the imaginary straight line ζ which connects the circumferential center of the concaved portion 14 to the center of the rotational shaft 12*c*. Accordingly, the concaved portion 14 is positioned on the second transfer nip 11*a* when the notch detector 23*a* of the photo sensor 23 detects the notch 24*a* and outputs the second transfer roller position signal (ON signal).

Figure 3A:
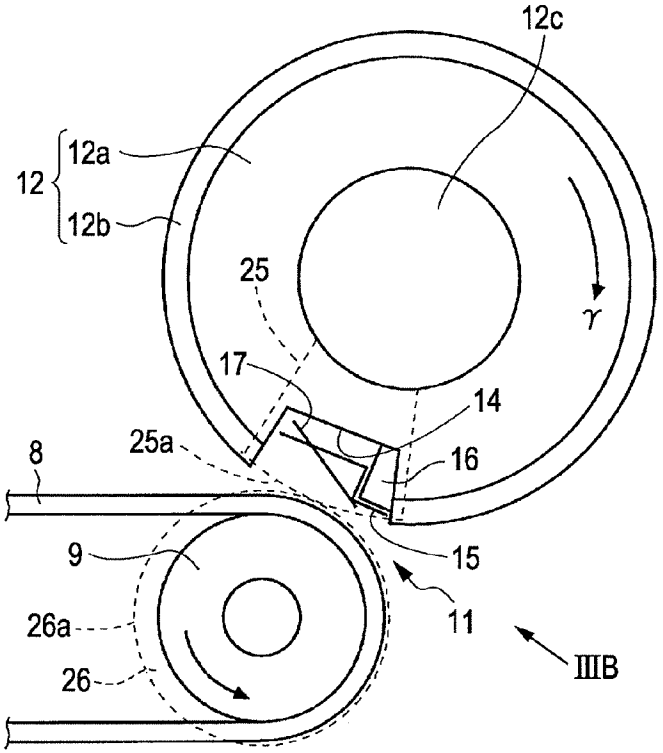
FIG. 3A is an explanatory view similar to FIG. 2A and shows the state in which the concaved portion is positioned on the transfer nip formation area according to the first embodiment.

As shown in FIGS. 3A and 3B, the partial circular shape outer surface 25*a* of the contact member 25 having a fan-shape substantially on the side of the second transfer roller 12 is integrally installed on the rotational shaft 12*c* to be rotatable with the second transfer roller 12 at a position corresponding to the concaved portion 14. A circular shape contact member 26 on the side of the intermediate transfer belt 8 is installed on the rotational shaft 9*a* of the intermediate transfer belt driving roller 9 to be unmovable to the axial direction of the rotational shaft 9*a* and relatively rotatable with respect to the rotational shaft 9*a*. When the concaved portion 14 is positioned on the second transfer nip 11*a*, the partial circular shape outer surface 25*a* of the contact member 25 on the side of the second transfer roller 12 is contacted with the outer surface 26*a* of the contact member 26 on the side of the intermediate transfer belt 8 and both rotational shafts 9*a*, 12*c* are positioned so as not to approach each other or so as not to substantially approach each other. Accordingly, when the concaved portion 14 is positioned at the transfer nip formation area as shown in FIG. 3A, the second transfer roller 12 (more specifically, the elastic member 12*b*) is not contacted with the intermediate transfer belt 8 by providing the contact members 25 and 26. Moreover, since the concaved portion 14 with width $w_1$ is set larger than the second transfer nip 11*a* with a width of $w_2$, the second transfer roller 12 can be reliably prevented from contacting the intermediate transfer belt 8 at the transfer nip formation area.

Figure 4B:
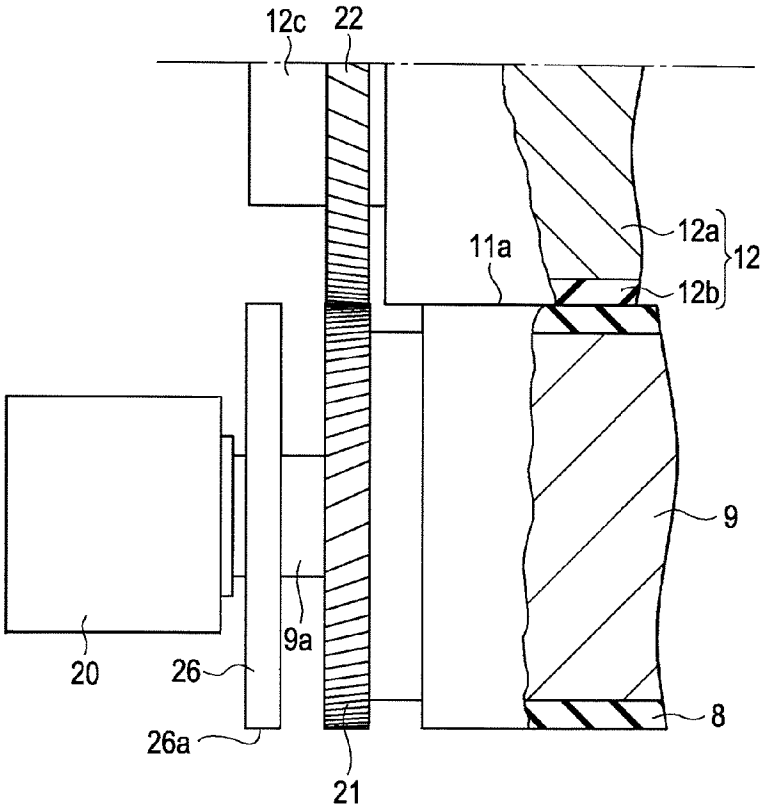
FIG. 4B is an explanatory drawing viewed in a direction indicated by an arrow IVB of FIG. 4A according to the first embodiment.
Figure 4A:
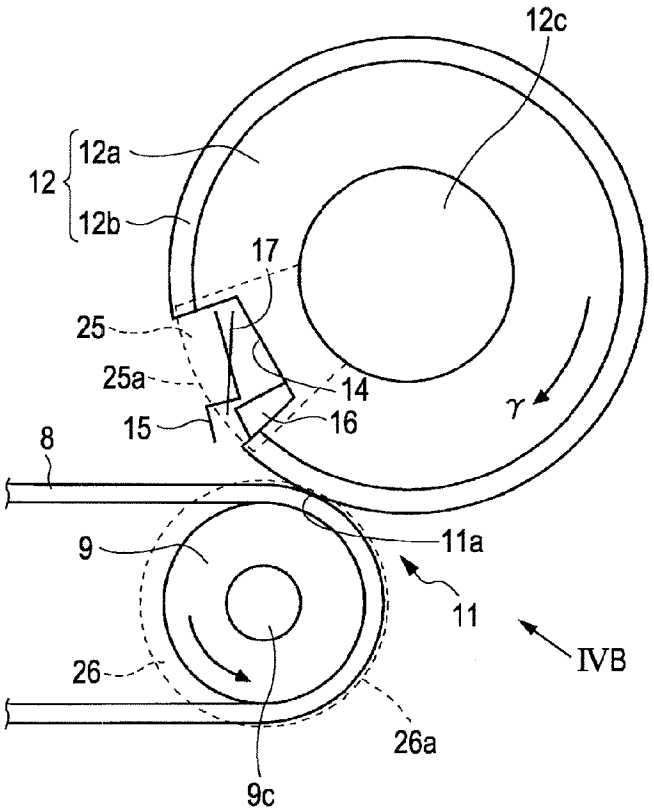
FIG. 4A is an explanatory view similar to FIG. 2A and shows the state in which the concaved portion is not positioned in the second transfer nip formation area according to the first embodiment.

As shown in FIGS. 4A and 4B, when the concaved portion 14 is separated from the transfer nip formation area, the partial shaped outer surface 25*a* of the contact member 25 on the side of the second transfer roller 12 and the outer surface 26*a* of the contact member 26 on the side of the intermediate transfer belt 8 are separated. Accordingly, the elastic member 12*b* of the second transfer roller 12 contacts the intermediate transfer belt 8 which is wound around the intermediate transfer belt driving roller 9, and the second transfer nip 11*a* is formed in the transfer nip formation area.

The second transfer roller cleaning section 13 removes the liquid developer which is attached on the elastic member 12*b* of the second transfer roller 12 with a cleaning member, such as a cleaning blade. The liquid developer which is removed by the cleaning member is returned to the liquid developer carrier.

Further, as shown in FIG. 1, the image forming apparatus 1 has a first air flow generator 27, a second air flow generator 28, a transfer material transporter 29, a third air flow generator 30 and an image fixing section 31. The first air flow generator 27 blows air toward the leading edge 19*a* of the transfer material 19 which is released from the pinch of the gripper 15 as indicated by the arrow. Accordingly, it is prevented that the leading edge 19*a* of the transfer material 19 is moved with the intermediate transfer belt 8 simultaneously. Also, the second air flow generator 28 suctions the air as indicated by the arrow so that the back surface of the transfer material 19 is drawn and separated from the second transfer roller 12. Accordingly, the transfer material 19 is drawn by the suction air generated by the second air flow generator 28 and the transfer material is transported to a transfer material transporter 29.

The transfer material transporter 29 has a transfer material transport belt 29*a* having a plurality of holes and rotating in arrow direction in endless shape, and a suction member 29*b*. When the transfer material 19 is transported to the transfer material transporter 29, the transfer material 19 is drawn by air suction of the suction member 29*b*, and transported toward the third air flow generator 30 by the transfer material transport belt 29*a*. The third air flow generator 30 suctions air as indicated by the direction of the arrow. By air suction of the third air flow generator 30, the back surface of the transfer material 19 which is separated from the second transfer roller 12 is drawn toward the third air flow generator 30. Accordingly, the transfer material 19 is drawn and guided to the third air flow generator 30, and the transfer material 19 moves toward the image fixing section 31 due to the rotational force of the transfer material transport belt 29*a*. So, the toner image of the transfer material 19 is heated, pressed and fixed by the image fixing section 31.

Figure 5:
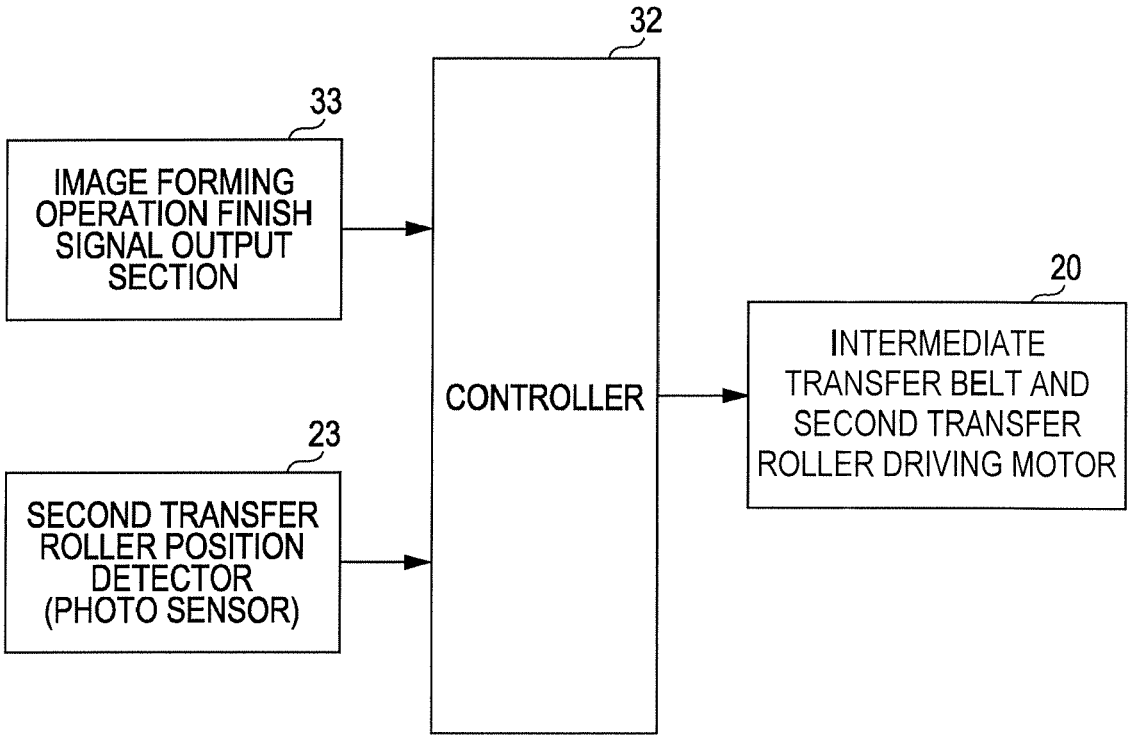
FIG. 5 is a block diagram showing a control for an intermediate transfer belt and a second transfer roller driving motor of the first embodiment.

FIG. 5 is a block diagram showing a control for the intermediate transfer belt/second transfer roller driving motor 20 of the image forming apparatus 1 of first embodiment of the invention.

As shown in FIG. 5, the intermediate transfer belt/second transfer roller driving motor 20 of the first embodiment are controlled by an electronic controller 32 of the image forming apparatus 1. In this case, the controller 32 controls the operation of the intermediate transfer belt/second transfer roller driving motor 20 on the basis of the second transfer roller position signal (the concaved portion position signal; ON signal) from the photo sensor 23 and the image forming operation finish signal (ON signal) from an image forming operation finish signal output section 33 so as to control the rotation of the intermediate transfer belt 8 and the second transfer roller 12. Therefore, the controller 32 controls the rotational position of the second transfer roller 12 (the rotational position of the concaved portion 14) on the basis of the second transfer roller position signal (ON signal) and the image forming operation finish signal (ON signal).

Figure 6:
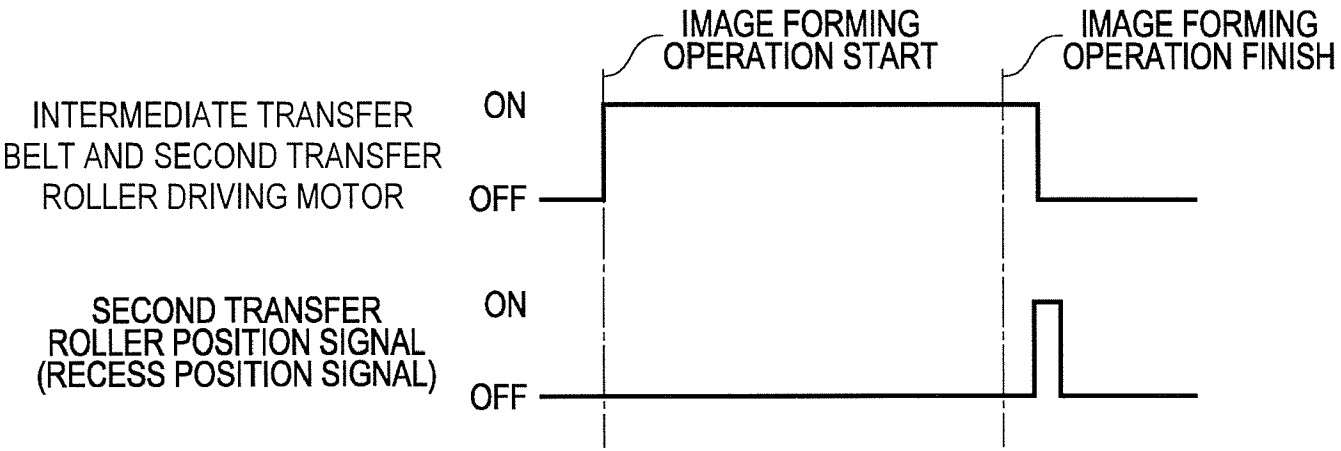
FIG. 6 is an explanatory view showing the sequence control for the intermediate transfer belt and the second transfer roller driving motor of a first embodiment.
Figure 7:
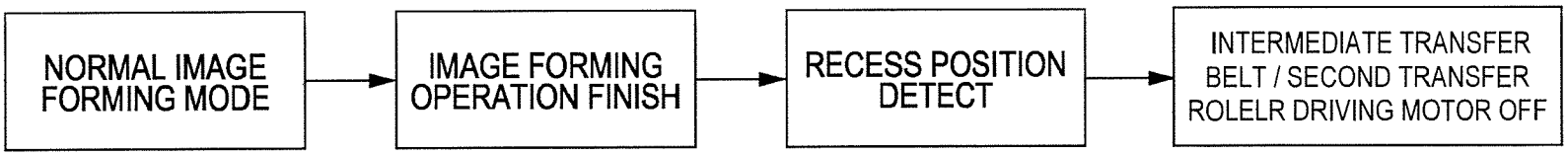
FIG. 7 is a flow chart showing the image forming operation until rotations of the intermediate transfer belt and the second transfer roller driving motor are stopped according to the first embodiment.

Next, the description will be made regarding the sequence control in the first embodiment which controls the rotation of the second transfer roller 12 on the basis of the image forming operation finish signal and the rotational position of the concaved portion 14 of the second transfer roller 12. FIG. 6 is an explanatory view showing the sequence control for an intermediate transfer belt and a second transfer roller driving motor of a first embodiment. FIG. 7 is a flow chart showing the image forming operation until the intermediate transfer belt/second transfer roller driving motor 20 is turned off according to the first embodiment.

As shown in FIG. 6 and FIG. 7, controller 32 sets the image forming apparatus 1 to normal image forming mode, when the image forming signal 10 is input by a user operating the operation button. Thus, the normal image forming operation is started by the image forming apparatus 1. Accordingly, the intermediate transfer belt/second transfer roller driving motor 20 is driven (ON). When the image forming operation is finished by the image forming apparatus 1, the image forming operation finish signal is output from the image forming operation finish signal output section 33 to the controller 32. After the image forming operation finish signal is output, when the concaved portion 14 is detected by the second transfer roller position detector initially, the second transfer roller position signal (ON signal) is output from the photo sensor 23 to the controller 32. When the second transfer roller position signal (ON signal) is input to the controller 32, the rotation of the intermediate transfer belt/second transfer roller driving motor 20 is stopped (OFF). As described above, in the state that the rotation of the intermediate transfer belt/second transfer roller driving motor 20 is stopped, the concaved portion 14 of the second transfer roller 12 is located at the transfer nip formation area, and the elastic member 12*b* of the second transfer roller 12 is not in contact with the intermediate transfer belt 8, as shown in FIGS. 3A and 3B.

Regarding the other constitution and other image forming operation of the image forming apparatus 1 in the first embodiment, these are the same as in the conventional related art image forming apparatus using a liquid developer, so the description thereof will be omitted.

In the image forming apparatus 1 of the first embodiment, the sheet shaped elastic member 12*b* is installed on the peripheral surface of the second transfer roller 12 having the concaved portion 14, and along with this, when the image forming operation is activated, the elastic member 12*b* is contacted and pressed to the intermediate transfer belt 8 to form the second transfer nip 11*a* in the transfer nip formation area. In this case, width $w_1$ in the peripheral direction of the concaved portion 14 of the second transfer roller 12 is set to be larger than width $w_2$ in the same direction of the transfer nip formation area where the second transfer nip 11*a* is formed ($w_1>w_2$). Further, when the image forming operation is not performed and the intermediate transfer belt/second transfer roller driving motor 20 is not driven, the second transfer roller 12 is stopped in a state in which the concaved portion 14 is placed in the transfer nip formation area so that the elastic member 12*b* is not in contact with the intermediate transfer belt 8. Thus, when the image forming apparatus 1 is not performing the image forming operation, the second transfer nip 11*a* is not formed between the intermediate transfer belt 8 and the second transfer roller 12. Accordingly, the twist occurrence can be suppressed in the elastic layer of the intermediate transfer belt 8 and the elastic member 12*b* of the second transfer roller 12, even though the second transfer belt 8 and the second transfer roller 12 is not driven for a long time. Also, the twist occurrence can be suppressed in the elastic member 12*b* of the second transfer roller 12, even though the second transfer belt 8 and the second transfer roller 12 are not driven for a long time. Accordingly, the image defect and/or banding which is caused by the twisting of the elastic member 12*b* of the second transfer roller 12 can be controlled effectively, whereby a good image quality can be obtained.

When the second transfer roller 12 is not rotated, the concaved portion 14 is positioned in the transfer nip formation area, so that the second transfer roller 12 can always stop in a constant position. Thus, when the next image forming operation is driven, the rotational position of the second transfer roller 12 can be controlled easily, so that the positioning between the rotational position of the second transfer roller 12 and the transported transfer material 19 can be accomplished easily.

Also, in the state in which the leading edge 19*a* of the transfer material 19 is pinched by the gripper 15, the transfer material 19 passes the second transfer nip 11*a*, so that the transfer material 19 can be separated easily from the intermediate transfer belt 8 after the second transfer.

Further, the intermediate transfer belt 8 has an elastic layer, so that the transfer efficiency can be raised even though the transfer material 19 has high surface roughness. The twist occurrence can be suppressed in the elastic layer of the second transfer belt 8 and the elastic member 12*b* of the second transfer roller 12, because the second transfer nip 11*a* is not formed even though the second transfer belt 8 and the second transfer roller 12 are not driven for a long time.

Second Embodiment

Referring now to FIGS. 8A, 8B, 9A, 9B, 10, 11A and 11B, an image forming apparatus and method in accordance with a second embodiment will now be explained. In view of the similarity between the first and second embodiments, the parts of the second embodiment that are identical to the parts of the first embodiment will be given the same reference numerals as the parts of the first embodiment. Moreover, the descriptions of the parts of the second embodiment that are identical to the parts of the first embodiment may be omitted for the sake of brevity.

Figure 8B:
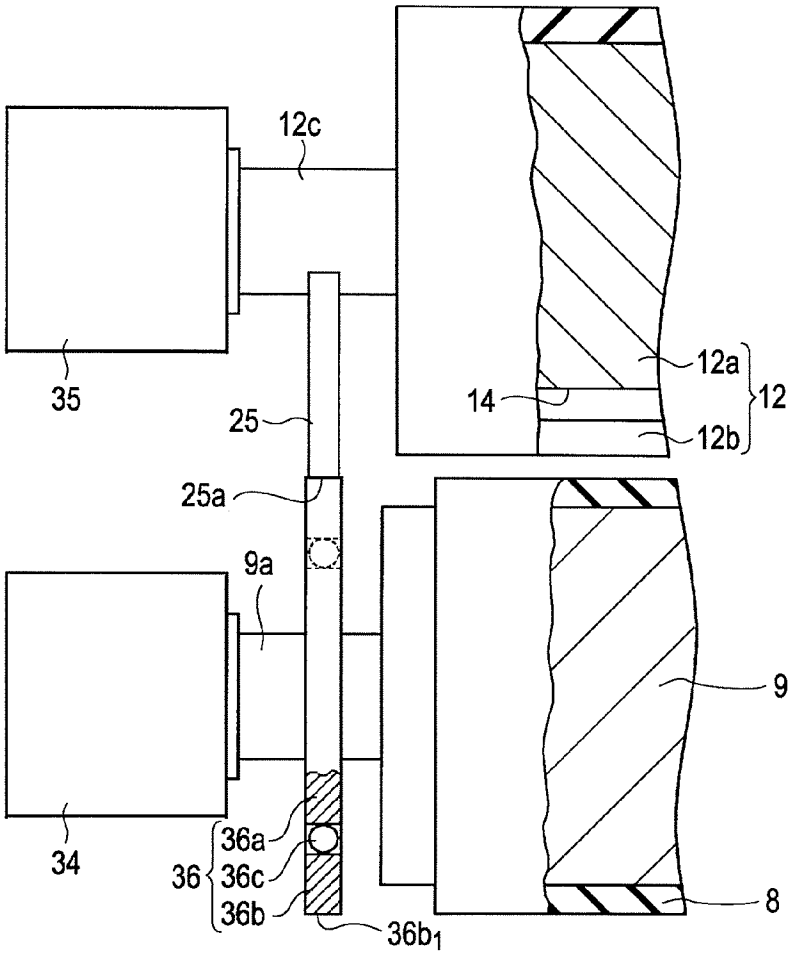
FIG. 8B is an explanatory drawing viewed in a direction indicated by an arrow VIIIB of FIG. 8A.
Figure 8A:
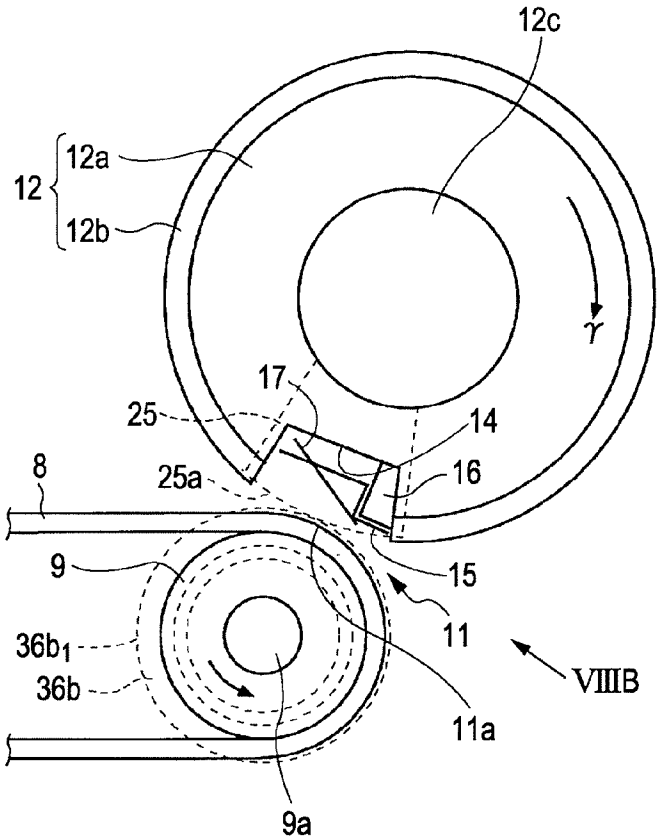
FIG. 8A is a partial view similar to FIG. 3A and shows the image forming apparatus according to a second embodiment of the present invention.
Figure 9B:
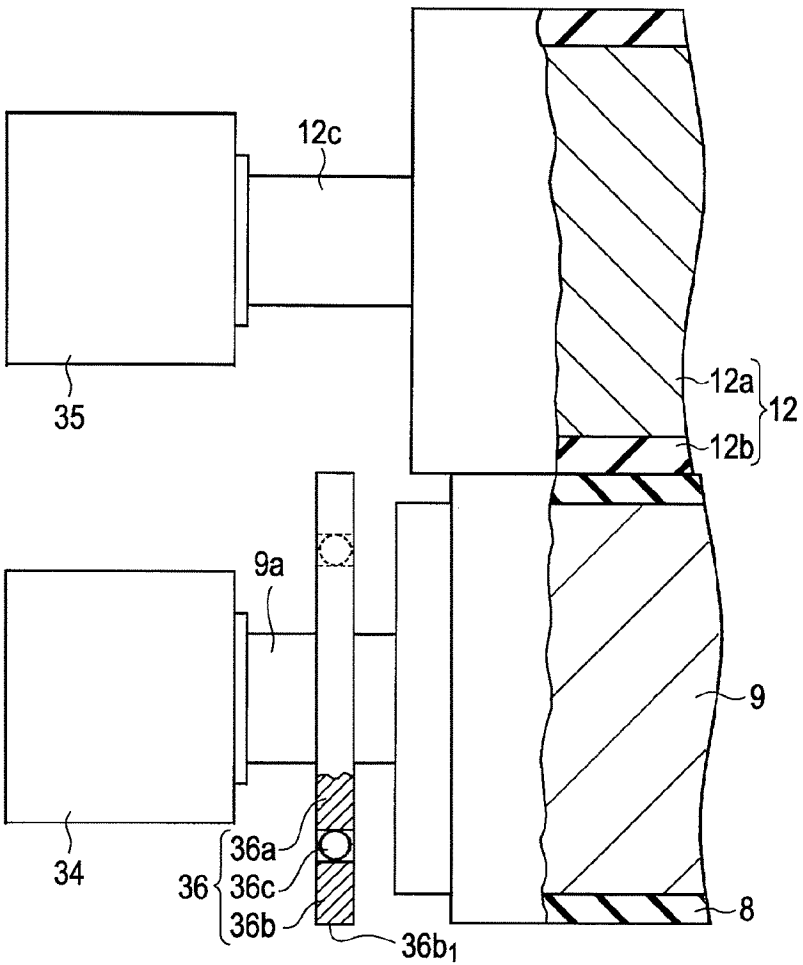
FIG. 9B is an explanatory drawing viewed in a direction indicated by an arrow IXB of FIG. 9A.
Figure 9A:
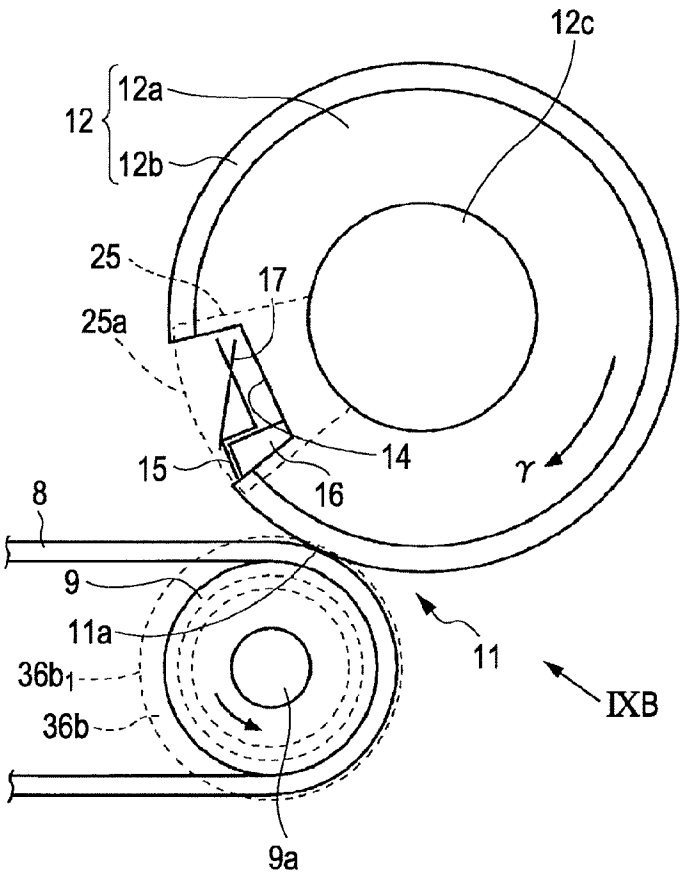
FIG. 9A is a view similar to FIG. 4A and shows the state in which the concaved portion is not positioned in the second transfer nip formation area according to the second embodiment of the invention.

FIG. 8A is a partial view showing the image forming apparatus of the second embodiment of the invention and is the same partial view as FIG. 3A, and FIG. 8B is an explanatory drawing viewed in the direction indicated by the arrow VIIIB of FIG. 8A. FIG. 9A is a view showing the second embodiment and is the same partial view as FIG. 4A, and FIG. 9B is an explanatory drawing viewed in the direction indicated by the arrow IXB of FIG. 9A.

The second embodiment differs from the first embodiment in that, as shown in FIGS. 8A, 8B, 9A, and 9B, each of the intermediate transfer belt driving roller 9 and the second transfer roller 12 is rotated by the individual intermediate transfer belt driving motor 34 (one example of the image carrier driving source of the present invention) and the second transfer roller driving motor 35 (one example of the transfer roller driving source of the present invention) respectively. In other words, the driving force of the intermediate transfer belt driving motor 34 is delivered to the intermediate transfer belt driving roller 9, so that the intermediate transfer belt driving roller 9 rotates counterclockwise as indicated by the direction of the arrow when viewed in the direction in FIG. 8A and FIG. 9A. Additionally, the driving force of the second transfer roller driving motor 35 is delivered to the rotational shaft 12*c* of the second transfer roller 12, so that the second transfer roller 12 rotates clockwise as indicated arrow direction (direction γ) when viewed in the direction in FIG. 8A and FIG. 9A. Thus, in the second embodiment, the middle gear 21 and the second transfer roller driving gear 22 in the first embodiment are not provided.

In the second embodiment, a contact member of the intermediate transfer belt side includes a bearing 36 instead of the contact member 26 of the first embodiment. In this embodiment, the bearing 36 is a ball bearing having an inner lace 36*a*, an outer lace 36*b*, and balls 36*c*. In this case, the inner lace 36*a* is integrally attached to be rotatable with the rotational shaft 9*a* of the intermediate transfer belt driving roller 9. Accordingly, the outer lace 36*b* can rotate relatively with respect to the rotational shaft 9*a*.

As shown in FIGS. 8A and 8B, on the side of the second transfer roller 12, the partial circular shape outer peripheral surface 25*a* of the contact member 25 contacts the outer peripheral surface $36b_1$ of the outer lace 36*b* when the concaved portion 14 of the second transfer roller 12 is located on the transfer nip formation area. Accordingly, the elastic member 12*b* of the second transfer roller 12 is separated from the intermediate belt 8 when the concaved portion 14 is located in the transfer nip formation area. Further, as shown in FIGS. 9A and 9B, on the side of the second transfer roller 12, the partial circular shape outer peripheral surface 25*a* of the contact member 25 is separated from the outer peripheral surface 36$b_1$ of the outer lace 36*b* when the concaved portion 14 of the second transfer roller 12 is located out of the transfer nip formation area. In this way, when the concaved portion 14 is located out of the second transfer nip 11*a*, the elastic member 12*b* of the second transfer roller 12 is contacted and pressed to the intermediate transfer belt 8, and the second transfer nip 11*a* is formed.

Figure 10:
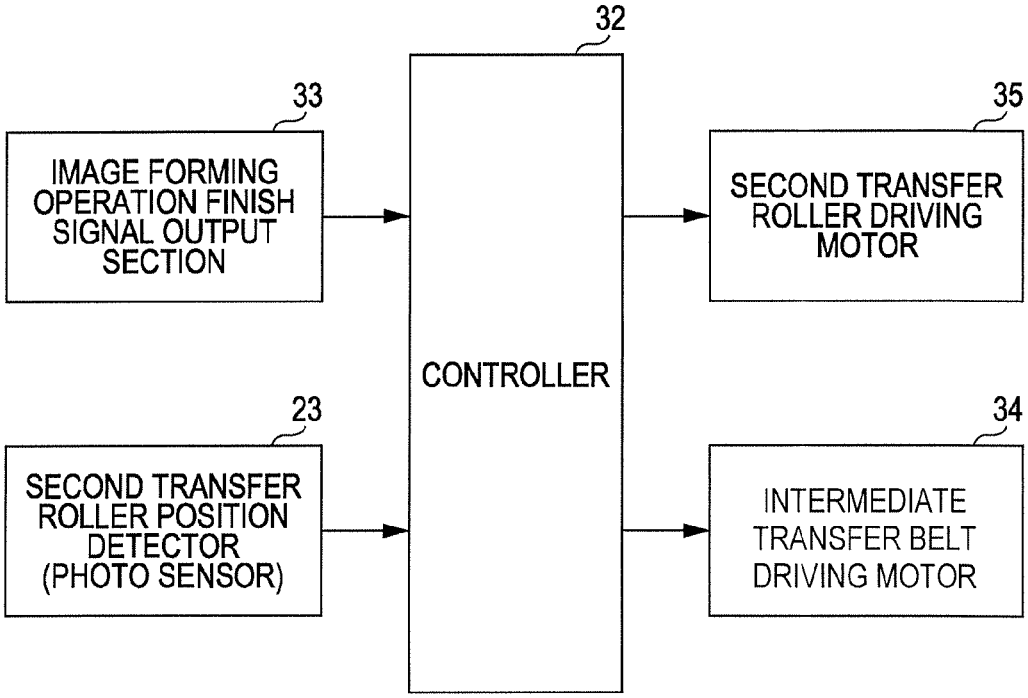
FIG. 10 is a block diagram showing the control for a second transfer roller driving motor and an intermediate transfer belt driving motor of the second embodiment.

With further reference to the second embodiment, as shown in FIG. 10, the controller 32 controls the rotation of the intermediate transfer belt 8 and the rotation of the second transfer roller 12 by controlling the rotation of the intermediate transfer belt driving motor 34 and the second transfer roller driving motor 35, on the basis of the second transfer roller position signal (the concaved portion position signal; ON signal) from the photo sensor 23 which detects the position of the second transfer roller 12 and the image forming operation finish signal (ON signal) from the image forming operation finish output section 33, in the same manner as the first embodiment. Accordingly, the controller 32 controls the rotational position of the second transfer roller 12 (the rotational position of the concaved portion 14) on the basis of the second transfer roller position signal (ON signal) and the image forming operation finish signal (ON signal).

Figure 11A:
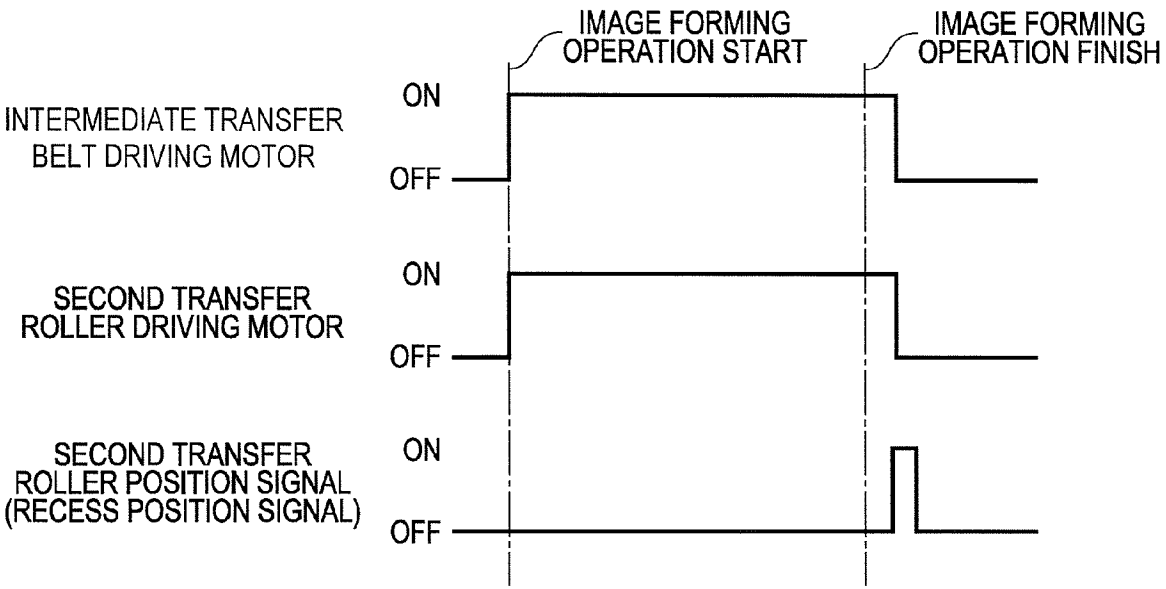
FIG. 11A is an explanatory view showing the sequence control for an intermediate transfer belt driving motor and a second transfer roller driving motor according to the second embodiment.

Next, the description will be made regarding the sequence control which controls the driving of the second transfer roller 12 on the basis of the image forming operation finish signal and the rotational position of the concaved portion 14 of the second transfer roller 12 in the second embodiment. FIG. 11A is an explanatory view showing the sequence control for the intermediate transfer belt driving motor 34 and the second transfer roller driving motor 35, and FIG. 11B is a flow chart showing the image forming operation until the intermediate transfer belt driving motor 34 and the second transfer roller driving motor 35 are turned off.

Figure 11B:
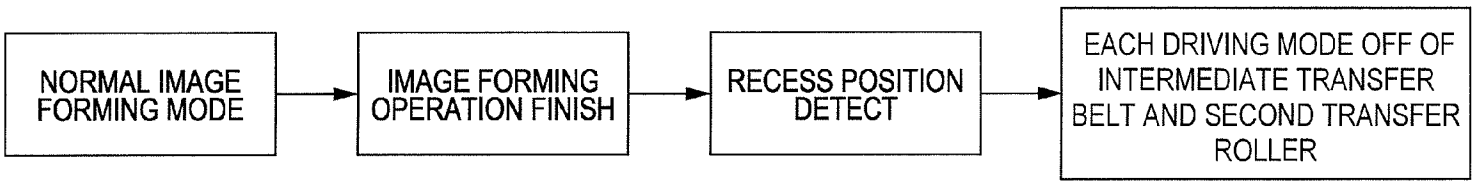
FIG. 11B is a flow chart showing the image forming operation until rotations of the intermediate transfer belt driving motor and the second transfer roller driving motor are stopped according to the second embodiment.

As shown in FIGS. 11A and 11B, when the image forming signal is input to the controller 32 as the user operates the operation button, the controller 32 sets the image forming apparatus 1 to the normal image forming mode. In this way, the image forming apparatus 1 starts the normal image forming operation. Accordingly, the intermediate transfer belt driving motor 34 and the second transfer roller driving motor 35 are driven respectively (ON). When the image forming apparatus 1 stops the image forming operation, the image forming operation finish signal is output from the image forming operation finish signal output section 33 to the controller 32 in the same manner to the first embodiment. After the image forming operation finish signal is output, from the photo sensor 23 to the controller 32, when the concaved portion 14 is initially detected by the second transfer roller position detector, the second transfer roller position signal (ON signal) is output from the photo sensor 23 to the controller 32. Thus, when the second transfer roller position signal (ON signal) is input to the controller 32, each rotation of the intermediate transfer belt driving motor 34 and the second transfer roller driving motor 35 is stopped respectively (OFF). As described above, in the state that the intermediate transfer belt driving motor 34 and the second transfer roller driving motor 35 are stopped, the concaved portion 14 of the second transfer roller 12 is located in the transfer nip formation area and the elastic member 12*b* of the second transfer roller 12 does not contact the intermediate transfer belt 8 as shown in FIGS. 8A and 8B in the same manner as the first embodiment as shown in FIGS. 3A and 3B.

According to the image forming apparatus 1 of the second embodiment, each rotation of the intermediate transfer belt driving motor 34 and the second transfer roller driving motor 35 can be controlled independently, so that velocity of the intermediate transfer belt driving motor 34 and the second transfer roller driving motor 35 can be set properly, respectively.

Also, the elastic member 12*b* of the second transfer roller 12 is not contacted with the intermediate transfer belt 8 when the intermediate transfer belt driving motor 34 is not driven and when the second transfer roller driving motor 35 is not driven. Therefore, in the state that the elastic member 12*b* is not contacted with the intermediate transfer belt 8, it can control the unstable sliding between the intermediate transfer belt 8 and the elastic member 12*b* of the second transfer roller 12 when the intermediate transfer belt 8 starts the independent rotation or when the intermediate transfer belt 8 stops the independent rotation after the independent rotation.

Other than this, the constitution and effects of the image forming apparatus in the second embodiment are the same as those of the first embodiment.

Third Embodiment

Figure 12A:
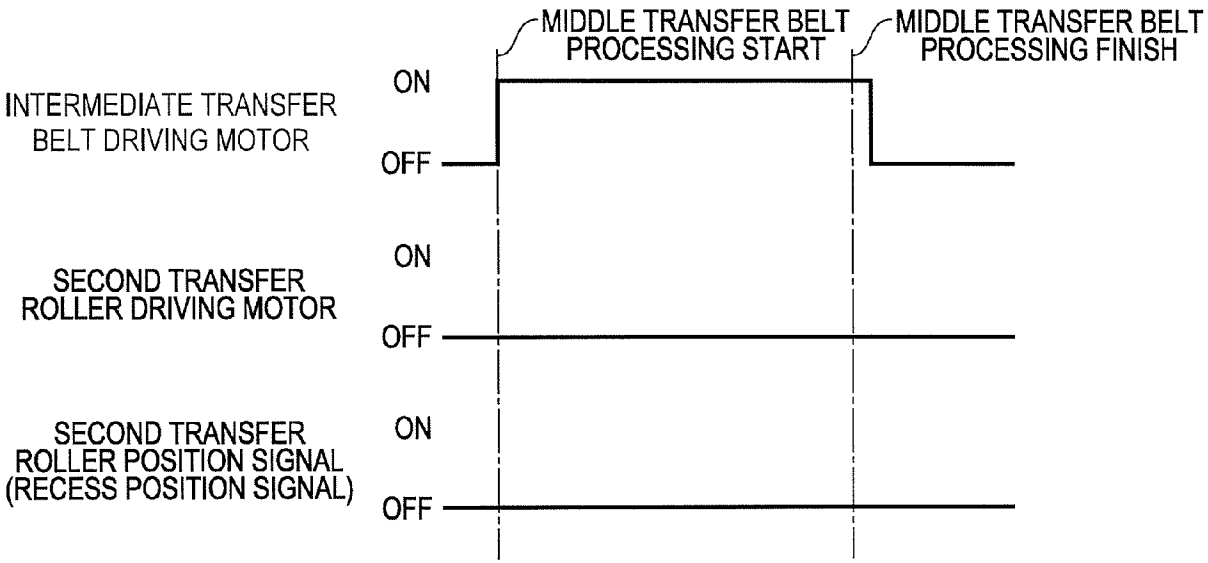
FIG. 12A is an explanatory view showing the signal in the sequence control for an intermediate transfer belt driving motor and a second transfer roller driving motor according to a third embodiment.
Figure 12B:
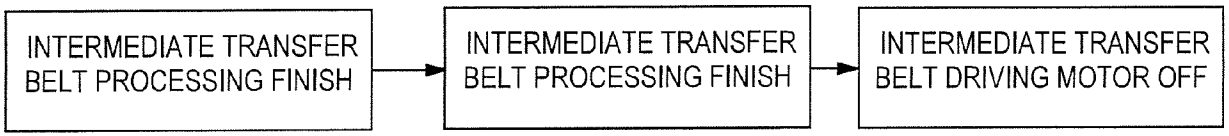
FIG. 12B is a flow chart showing a process of controlling the intermediate transfer belt until the intermediate transfer belt driving motor is turned off according to the third embodiment.

Referring now to FIGS. 12A and 12B, an image forming apparatus and method in accordance with a third embodiment will now be explained. In view of the similarity between the second and third embodiments, the parts of the third embodiment that are identical to the parts of the second embodiment will be given the same reference numerals as the parts of the second embodiment. Moreover, the descriptions of the parts of the third embodiment that are identical to the parts of the second embodiment may be omitted for the sake of brevity.

FIG. 12A is an explanatory view showing a signal in the sequence control for an intermediate transfer belt driving motor 34 and the second transfer roller driving motor 35 of the image forming apparatus of the third embodiment, and FIG. 12B is a flow chart showing a management of the intermediate transfer belt 8 until the intermediate transfer belt driving motor 34 is turned off.

The third embodiment is directed to when the intermediate transfer belt 8 is driven in the state that the second transfer roller 12 is stopped, so that the intermediate transfer belt 8 undergoes a process such as cleaning or resist matching with respect to the intermediate transfer belt 8. In this case, in the third embodiment, the intermediate transfer belt driving motor 34 and the second transfer roller driving motor 35 can use the block diagram of FIG. 10 in the same manner as the second embodiment.

The controller 32 controls the actuation of the intermediate transfer belt driving motor 34, in the other words, the rotation of the intermediate transfer belt 8 on the basis of the second transfer roller position signal (the concaved portion position signal; ON signal) from the photo sensor 23 and the intermediate transfer belt processing signal (ON signal) from the intermediate transfer belt processing signal output section. More specifically, in the third embodiment, the controller 32 stops the second transfer roller driving motor 35 when the second transfer roller position signal (ON signal) is output from the photo sensor 23 to the controller 32. Accordingly, the controller 32 controls the rotational position of the second transfer roller 12 (the rotational position of the concaved portion 14) on the basis of the position signal (ON signal) of the second transfer roller 12 and the finish signal (ON signal) of the image forming operation.

Next, the description will be made regarding the sequence control which controls the actuation of the intermediate transfer belt 8 on the basis of the intermediate transfer belt processing signal and the second transfer roller position signal in the third embodiment.

As shown in FIGS. 12A and 12B, the controller 32 sets the image forming apparatus to the intermediate transfer belt processing mode, when the intermediate transfer belt processing signal is input to the controller 32 from the intermediate transfer belt processing signal output section. The intermediate transfer belt processing mode refers to a mode in which the intermediate transfer belt 8 undergoes cleaning or resist matching. The image forming apparatus 1 is set to the intermediate transfer belt processing mode, so that the controller 32 actuates the intermediate transfer belt driving motor 34 (ON) and the intermediate transfer belt 8 rotates in the direction β (shown in FIG. 8A). At this time, the second transfer roller 12 is stopped, so the concaved portion 14 is located on the second transfer nip 11*a* position. Accordingly, the elastic member 12*b* of the second transfer roller 12 is not contacted with the intermediate transfer belt 8 and the intermediate transfer belt 8 rotates stably and smoothly. Thus, the intermediate transfer belt 8 is processed by the rotation of the intermediate transfer belt 8 as described above. The intermediate transfer belt processing finish signal is output from the intermediate transfer belt processing signal output section to controller 32, when the processing regarding the intermediate transfer belt 8 is finished. Thus, the controller 32 stops the actuation of the intermediate transfer belt driving motor 34, and the rotation of the intermediate transfer belt 8 is stopped.

According to the image forming apparatus of the third embodiment, in the state that the concaved portion 14 stops the rotation of the second transfer roller 12 at the transfer nip formation area, the intermediate transfer belt 8 is rotated. Thus, in the state that the elastic member 12*b* of the second transfer roller 12 is not contacted with the intermediate transfer belt 8, it is possible to rotate the intermediate transfer belt 8. However, in the case of the image forming apparatus, in which the second transfer roller 12 always contacts presses the intermediate transfer belt, when the cleaning or resist matching of the intermediate transfer belt 8 is processed, the distance between the rotational shaft of the second transfer roller and the rotational shaft of the intermediate transfer belt driving roller 9 is changed, so that it is necessary to separate the second transfer roller 12 from the intermediate transfer belt 8. Otherwise, in the image forming apparatus of the third embodiment, the second transfer roller 12 can be separated from the intermediate transfer belt 8 without substantially changing the distance between the rotational shaft 12*c* of the second transfer roller 12 and the rotational shaft 9*a* of the intermediate transfer belt driving roller 9. Thus, the processing with respect to the intermediate transfer belt 8 described above can be processed easily.

Other than this, the constitution and effects of the image forming apparatus in the third embodiment are the same as those of the second embodiment.

Fourth Embodiment

Referring now to FIGS. 13A, 13B, 14, 15A and 15B, an image forming apparatus and method in accordance with a fourth embodiment will now be explained. In view of the similarity between the previous embodiments and the fourth embodiment, the parts of the fourth embodiment that are identical to the parts of the previous embodiments will be given the same reference numerals as the parts of the previous embodiment. Moreover, the descriptions of the parts of the fourth embodiment that are identical to the parts of the previous embodiments may be omitted for the sake of brevity.

Figure 13A:
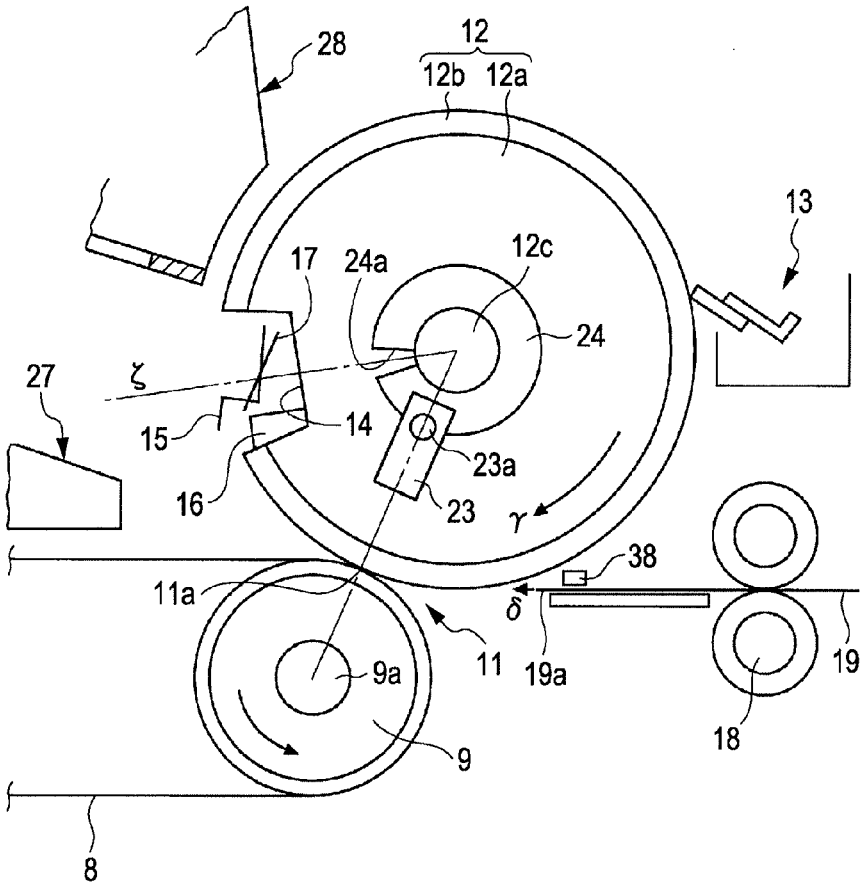
FIG. 13A is a partial view similar to FIG. 2A and shows the second transfer section of the image forming apparatus according to a fourth embodiment of the present invention.
Figure 13B:
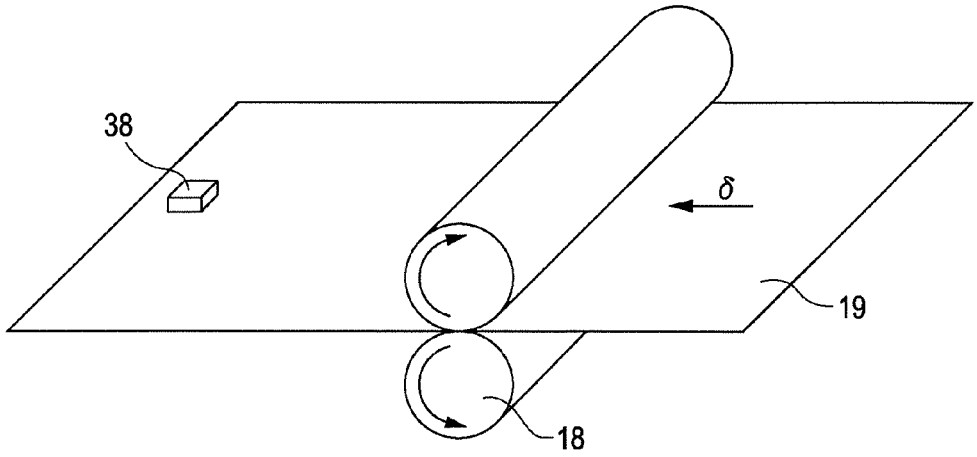
FIG. 13B is an explanatory view showing a detection of presence or absence of the transfer material according to the fourth embodiment.
Figure 14:
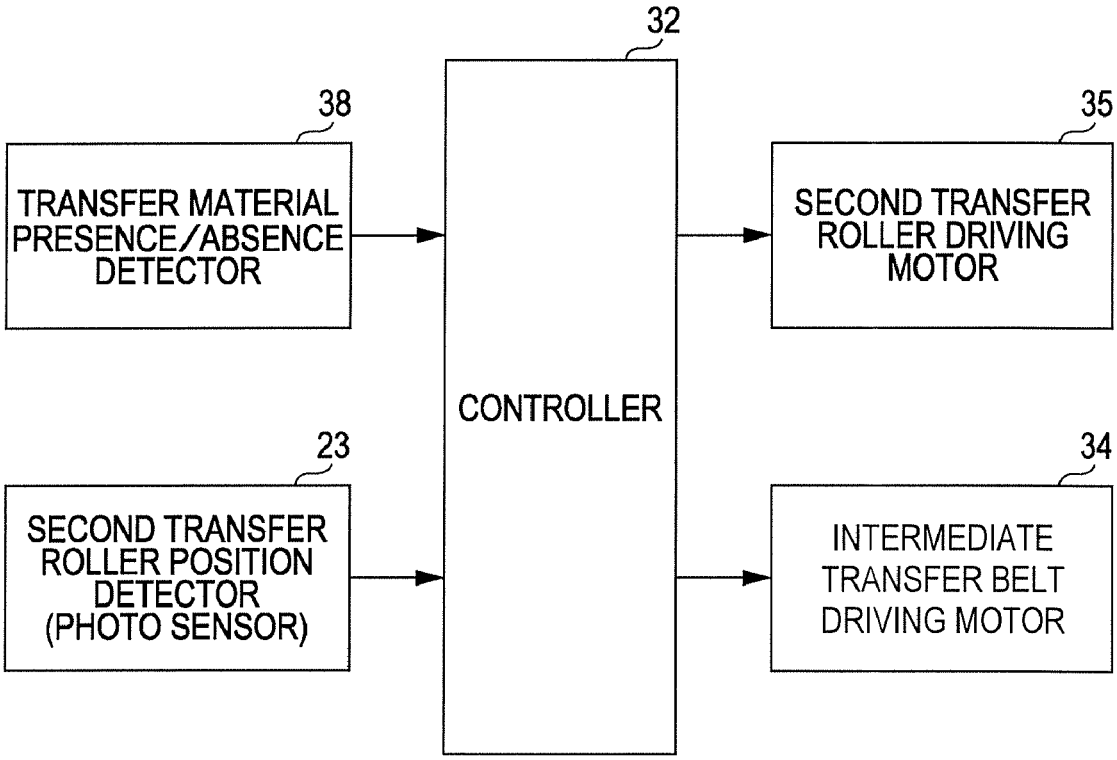
FIG. 14 is a block diagram similar to FIG. 10 showing the control for each of the second transfer roller driving motor and the intermediate transfer belt driving motor according to the fourth embodiment.

FIG. 13A is a partial view similar to FIG. 2A showing a second transfer section of the fourth embodiment of the image forming apparatus of the invention, and FIG. 13B is an explanatory drawing a detection of the transfer material presence. FIG. 14 is a block diagram similar to FIG. 10 showing the control for each of the second transfer roller driving motor 34 and the intermediate transfer belt driving motor 35 of the fourth embodiment.

As shown in FIG. 13A, the image forming apparatus of the fourth embodiment has the transfer material presence/absence detector 38 using a reflective type sensor between the transfer nip formation area and the gate roller 18. As shown in FIG. 13B, the transfer material presence/absence detector 38 outputs OFF signal when the transfer material 19 which is transported from the gate roller 18 is detected at the transfer material detection timing position detecting the transfer material 19, and outputs ON signal when the transfer material 19 is not detected at the same position. Thus, the transfer material presence/absence detector 38 outputs ON signal, when the transfer material 19 is not detected at the detection timing position. In this case, ON signal output from the transfer material presence/absence detector 38 is the transfer material presence/absence signal (ON signal indicates the transfer material is absent at the detection position). Also, as the transfer material presence/absence detector 38, for example, a photo interrupter from Sharp Corporation (GP2A25J0000F series) can be used.

As shown in FIG. 14, the photo sensor 23 detecting the position of the second transfer roller 12, the transfer material presence/absence detector 38, the transfer material belt driving motor 34 and the second transfer roller driving motor 35 are connected to the controller 32.

Further, the controller 32 controls the actuation of the second transfer roller driving motor 35, and controls the rotational position (the rotational position of the concaved portion 14) of the second transfer roller 12, on the basis of the second transfer roller position signal (the concaved portion position signal; ON signal) from the photo sensor 23 and the transfer material presence/absence signal (ON signal) from the transfer material presence/absence detector 38. In other words, the transfer material presence/absence signal (ON signal) is input to the controller 32 from the transfer material presence/absence detector 38, and it is determined that the transfer material 19 is jammed, then the second transfer roller position signal (ON signal) is input to stop the actuation of the second transfer roller driving motor 35. In this way, when the jam of the transfer material 19 has occurred in front of the transfer material presence/absence detector 38 in the material transporting direction, the concaved portion 14 of the second transfer roller 12 is stopped at the transfer nip formation area. Thus, when the second transfer roller 12 is stopped due to the occurrence of the jam in the transfer material 19, the elastic member 12*b* of the second transfer roller 12 is not contacted with the intermediate transfer belt 8.

Figure 15A:
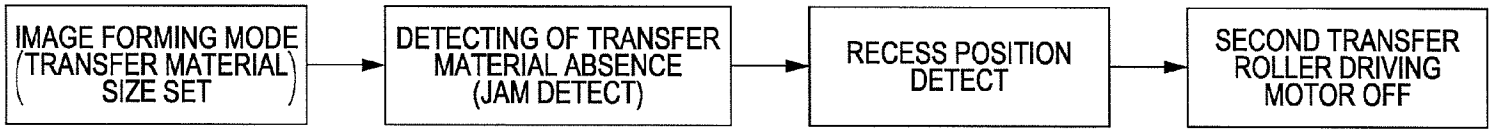
FIG. 15A is a flow chart showing a process of controlling the second transfer roller driving motor until the driving motor is turned off when a jam of the transfer material occurs.

Next, the description regarding the sequence control of the fourth embodiment will be made wherein the sequence control controls the rotation of the second transfer roller 12 on the basis of the transfer material presence/absence signal and the second transfer roller position signal. FIG. 15A is a flow chart showing a process of the second transfer roller driving motor 35 until the second transfer roller driving motor 35 is turned off when a jam of the transfer material 19 occurs, and FIG. 15B is an explanatory view showing a signal in the sequence control for the intermediate transfer belt driving motor 34 and the second transfer roller driving motor 35 when a jam of the transfer material 19 occurs.

Figure 15B:
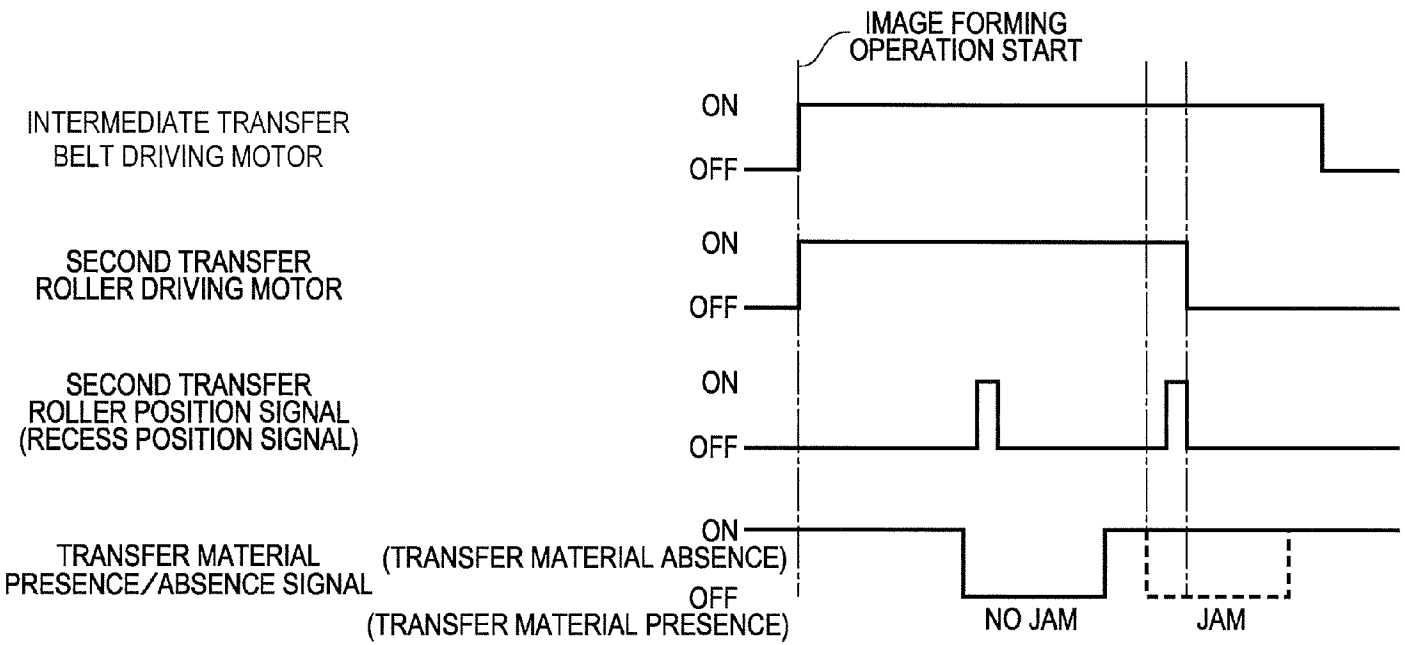
FIG. 15B is an explanatory view showing a signal in the sequence control for an intermediate transfer belt driving motor and a second transfer roller driving motor when a jam of the transfer material occurs.

As shown in FIGS. 15A and 15B, when the image forming signal which set up the transfer material size is input to the controller 32 by a user operating the operation button, the controller 32 sets the image forming apparatus to the image forming mode. Accordingly the image forming apparatus starts the normal image forming operation. Thus, each of the intermediate transfer belt driving motor 34 and the second transfer roller driving motor 35 is driven respectively (ON), and the intermediate transfer belt 8 rotates in the direction β shown in FIG. 1, and the second transfer roller 12 rotates in the direction γ shown in FIG. 13A. As described above, after the leading edge 19*a* of the transfer material 19 which is transported from the gate roller 18 is pinched by the gripper 15, the transfer material 19 enters the second transfer nip 11*a*. Thus, in the second transfer nip 11*a*, the toner image which is transferred by the intermediate transfer belt 8 is transferred to the transfer material 19.

At this time, the transfer material presence/absence detector 38 does not detect the transfer material 19, and outputs the transfer material presence/absence signal (ON signal; signal that the transfer material is absent) until the transfer material 19 which is transported from the gate roller 18 reaches the detection timing position of the transfer material presence/absence detector 38. When the transfer material 19 reaches the detection timing position of the transfer material presence/absence detector 38, so that the transfer material presence/absence detector 38 detects the transfer material 19, the transfer material presence/absence detector 38 outputs the transfer material presence/absence signal (OFF signal; signal that the transfer material is present). In other words, the jam of the transfer material 19 does not occur (when the jam does not occur). Moreover, when the transfer material presence/absence detector 38 does not detect the transfer material 19 at the detection timing position, regardless of whether the jam of the transfer material occurs or does not occur, the transfer material presence/absence detector 38 outputs ON signal, so that any of ON signals is indicated as the transfer material presence/absence signal (ON signal) for convenience of the description in FIG. 15B. As described above, even if the size of the transfer material 19 in the transfer material transporting direction is the maximum size used in the image forming apparatus 1, the transfer material 19 is separated from the second transfer roller 12 until the concaved portion 14 reaches the position of the transfer nip formation area next time. Thus, the transfer material presence/absence detector 38 outputs the transfer material presence/absence signal (ON signal) again, until the next second transfer roller position signal (ON signal) is output.

If the transfer material 19 which is transported from the gate roller 18 is jammed, so that the transfer material 19 does not reach the detection timing position of the transfer material presence/absence detector 38, the transfer material presence/absence detector 38 does not detect the transfer material 19 at the detection timing position. Because of this, the transfer material presence/absence signal from the transfer material presence/absence detector 38 does not become OFF, and the transfer material presence/absence detector 38 outputs the transfer material presence/absence signal (ON signal) to the controller 32 continuously (detection that the transfer material is absent). In other words, the jam of the transfer material 19 occurs (when the jam occurs). Then, the controller 32 determines that the jam of the transfer material 19 has occurred, and when the second transfer roller position signal (ON signal) is input subsequently, the actuation of the second transfer roller driving motor 35 is stopped. Accordingly, when the jam of the transfer material 19 occurs, the second transfer roller 12 is stopped in the state that the elastic member 12*b* is not contacted to the intermediate transfer belt 8. Then, the controller 32 stops the actuation of the intermediate transfer belt driving motor 34, and the intermediate transfer belt 8 is stopped.

Thus, when the jam of the transfer material 19 is detected, the second transfer roller 12 rotates until the concaved portion 14 reaches the position of the second transfer nip 11*a*, and when the concaved portion 14 reaches the position of the second transfer nip 11*a*, the second transfer roller 12 is stopped. At this time, when the second transfer roller 12 rotates after the jam of the transfer material 19 is detected, the intermediate transfer belt 8 rotates too. Also, when the second transfer roller 12 rotates after the jam of the transfer material 19 is detected, the intermediate transfer belt 8 does not necessarily have to rotate. However, it is preferable to rotate the intermediate transfer belt 8 when the second transfer roller 12 rotates after the jam of the transfer material 19 is detected to decrease the friction between the second transfer roller 12 and the intermediate transfer belt 8.

According to the image forming apparatus of the fourth embodiment, when the jam of the transfer material 19 which is transported from gate roller 18 has occurred, the controller 32 stops the rotation of the second transfer roller 12 so that the concaved portion 14 is located to the position of the second transfer nip 11*a* on the basis of the second transfer roller position signal (ON signal) and the transfer material presence/absence signal (ON signal) from the transfer material presence/absence detector 38. Thus, it can be suppressed that the toner of the image transported on the intermediate transfer belt 8 may be attached on the second transfer roller 12. In particular, as shown in FIG. 13A, the detection timing position of the transfer material presence/absence detector 38 for detecting the transfer material 19 is set immediately upstream of the detection position of the concaved portion 14 by the photo sensor 23, so that it can be more effectively suppressed that the toner of the image carried on the meddle transfer belt 8 may be attached on the second transfer roller 12.

In other respects, the constitution and effects of the image forming apparatus 1 in the fourth embodiment are the same as those in the second embodiment.

Fifth Embodiment

Referring now to FIGS. 16, 17, 18A and 18B an image forming apparatus and method in accordance with a fifth embodiment will now be explained. In view of the similarity between the previous embodiments and the fifth embodiment, the parts of the fifth embodiment that are identical to the parts of the previous embodiments will be given the same reference numerals as the parts of the previous embodiments. Moreover, the descriptions of the parts of the fifth embodiment that are identical to the parts of the previous embodiments may be omitted for the sake of brevity.

Figure 16:
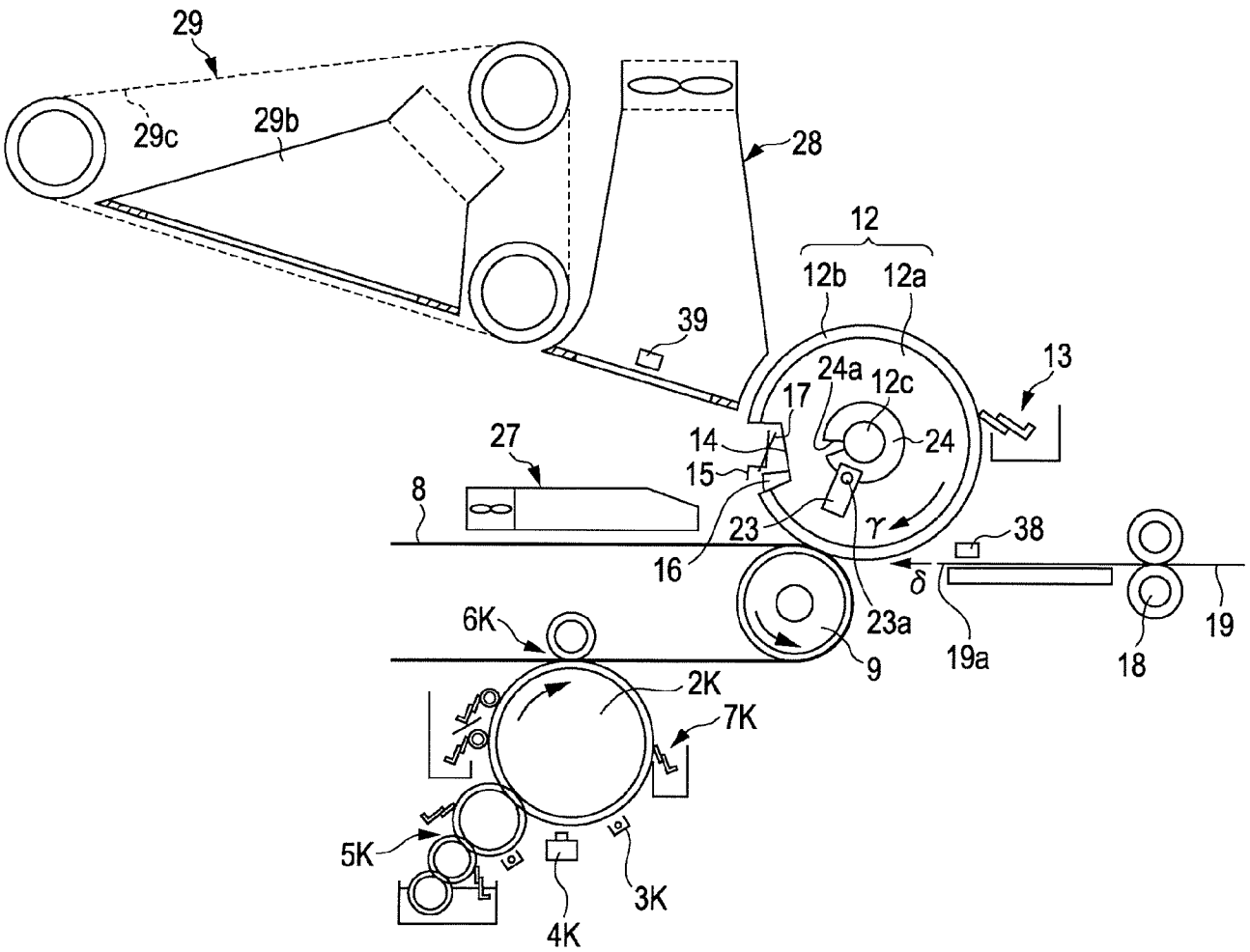
FIG. 16 is a partial view showing the image forming apparatus according to a fifth embodiment of the invention.
Figure 17:
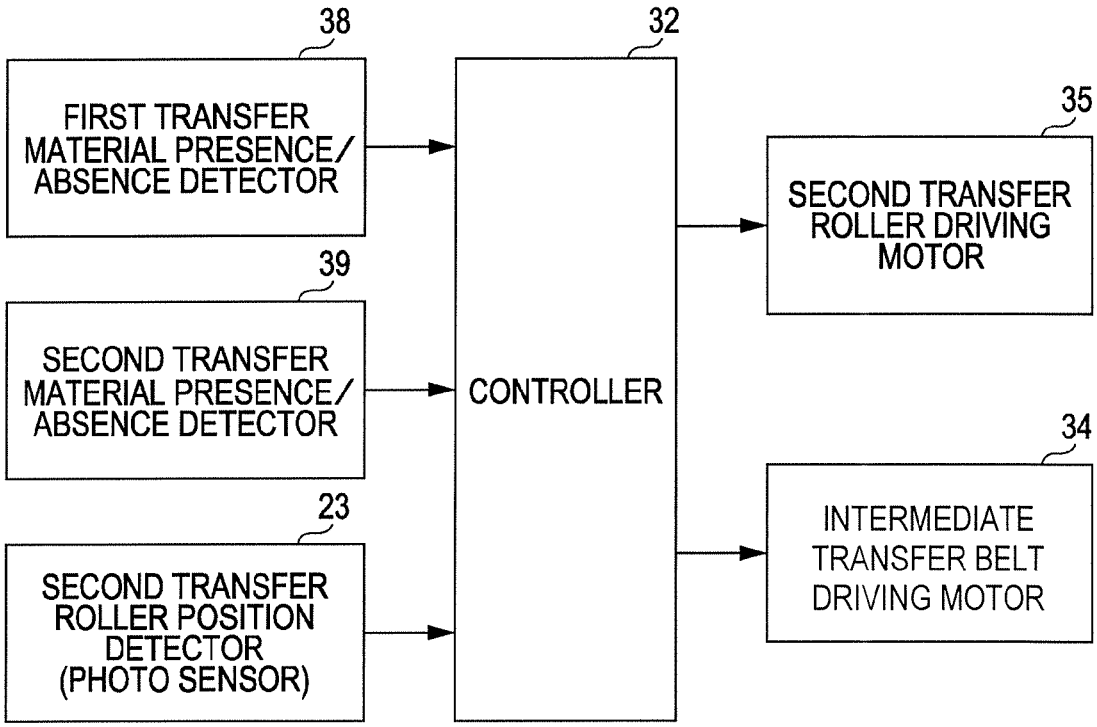
FIG. 17 is a block diagram similar to FIG. 14 and shows a control for each of the second transfer roller driving motor and the intermediate transfer belt driving motor of a fifth embodiment.

FIG. 16 is a partial view showing the image forming apparatus according to the fifth embodiment of the invention. FIG. 17 is a block diagram similar to FIG. 14 showing a control for each of the second transfer roller driving motor 34 and the intermediate transfer belt driving motor 35 of the fifth embodiment.

In the image forming apparatus of the fifth embodiment, in addition to the transfer material presence/absence detector 38 (herein after the first transfer material presence/absence detector 38, in the fifth embodiment) of the fourth embodiment, the second air flow generator 28 has the second transfer material presence/absence detector 39. The second transfer material presence/absence detector 39 detects the jam of the transfer material 19 which is already detected by the first transfer material presence/absence detector 38. The second transfer material presence/absence detector 39 may be the same as the first transfer material presence/absence detector 38, for example, a photo sensor may be used as described above.

As shown in FIG. 17, the photo sensor 23 which detects the position of the second transfer roller 12, the first transfer material presence/absence detector 38, the second transfer material presence/absence detector 39, the intermediate transfer belt driving motor 34 and the second transfer roller driving motor 35 are connected to the controller 32.

Further, the controller 32 controls the actuation of the second transfer roller driving motor 35, and controls the rotational position (rotational position of the concaved portion 14) of the second transfer roller 12 (rotational position of the concaved portion 14), on the basis of the second transfer roller position signal (the concaved portion position signal; ON signal) from the photo sensor 23, the first transfer material presence/absence signal (ON signal) from the first transfer material presence/absence detector 38 and the second transfer material presence/absence signal (ON signal) from the second transfer material presence/absence detector 39. In other words, the first transfer material presence/absence signal (ON signal) from the first transfer material presence/absence detector 38 is input in the controller 32 in the state that the second transfer roller 12 rotates in the direction γ (forward rotational direction). If the determination is that the jam of the transfer material 19 has occurred, then the actuation of the second transfer roller driving motor 35 is stopped when the second transfer roller position signal (ON signal) is input initially in the same manner as described above in the fourth embodiment. Thus, the concaved portion 14 of the second transfer roller 12 is stopped on the position of the transfer nip formation area when the jam of the transfer material 19 has occurred ahead of the first transfer material presence/absence detector 38 in the moving direction of the transfer material. Accordingly, if the second transfer roller 12 is stopped, when a jam of the transfer material 19 occurs, the elastic member 12*b* of the second transfer roller 12 is not contacted to the intermediate transfer belt 8.

Furthermore, if the controller 32 determines there is no jam occurrence of the transfer material 19 because the first transfer material presence/absence signal (OFF signal) is input from the first transfer material presence/absence detector 38, and the controller 32 determines there is a jam occurrence of the transfer material 19 because the second transfer material presence/absence signal (ON signal) is input from the second transfer material presence/absence detector 39, the concaved portion 14 passes through the transfer nip formation area, so that the second transfer roller driving motor 35 rotates in reverse. Thus, the second transfer roller 12 is controlled to rotate in reverse (reverse to the direction γ). After that, when the second transfer rotational position signal (ON signal) is input, the actuation of the second transfer roller driving motor 35 is stopped. Thus, after the first transfer material presence/absence detector 38 detects the transfer material 19 and when the second transfer material presence/absence detector 39 does not detect the transfer material 19, the second transfer roller 12 rotates in reverse so that the concaved portion 14 is stopped at the position of the second transfer nip 11*a*. Thus, after the second transfer material presence/absence detector 39 detects the jam occurrence of the transfer material 19, the elastic member 12*b* of the second transfer roller 12 is not contacted to the intermediate transfer belt 8 when the second transfer roller 12 is stopped.

Figure 18A:
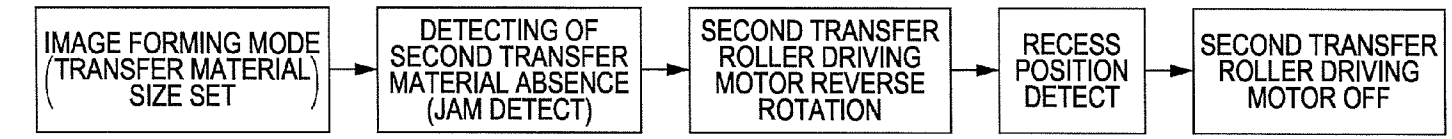
FIG. 18A is a flow chart showing a process of controlling the second transfer roller driving motor until the driving motor is turned off when a second jam of the transfer material occurs.

Next, the description regarding sequence control in the fifth embodiment will be made wherein the sequence control controls the actuation of the intermediate transfer belt 8 on the basis of the first transfer material presence/absence signal, the second transfer material presence/absence signal and the second transfer roller position signal in the fifth embodiment. FIG. 18A is a flow chart showing a process of the second transfer roller driving motor 35 until the second transfer roller driving motor 35 is turned off when a second jam of the transfer material occurs, and FIG. 18B is an explanatory view showing a signal in the sequence control for each of the intermediate transfer belt driving motor 34 and the second transfer roller driving motor 35 when a second jam of the transfer material occurs.

Figure 18B:
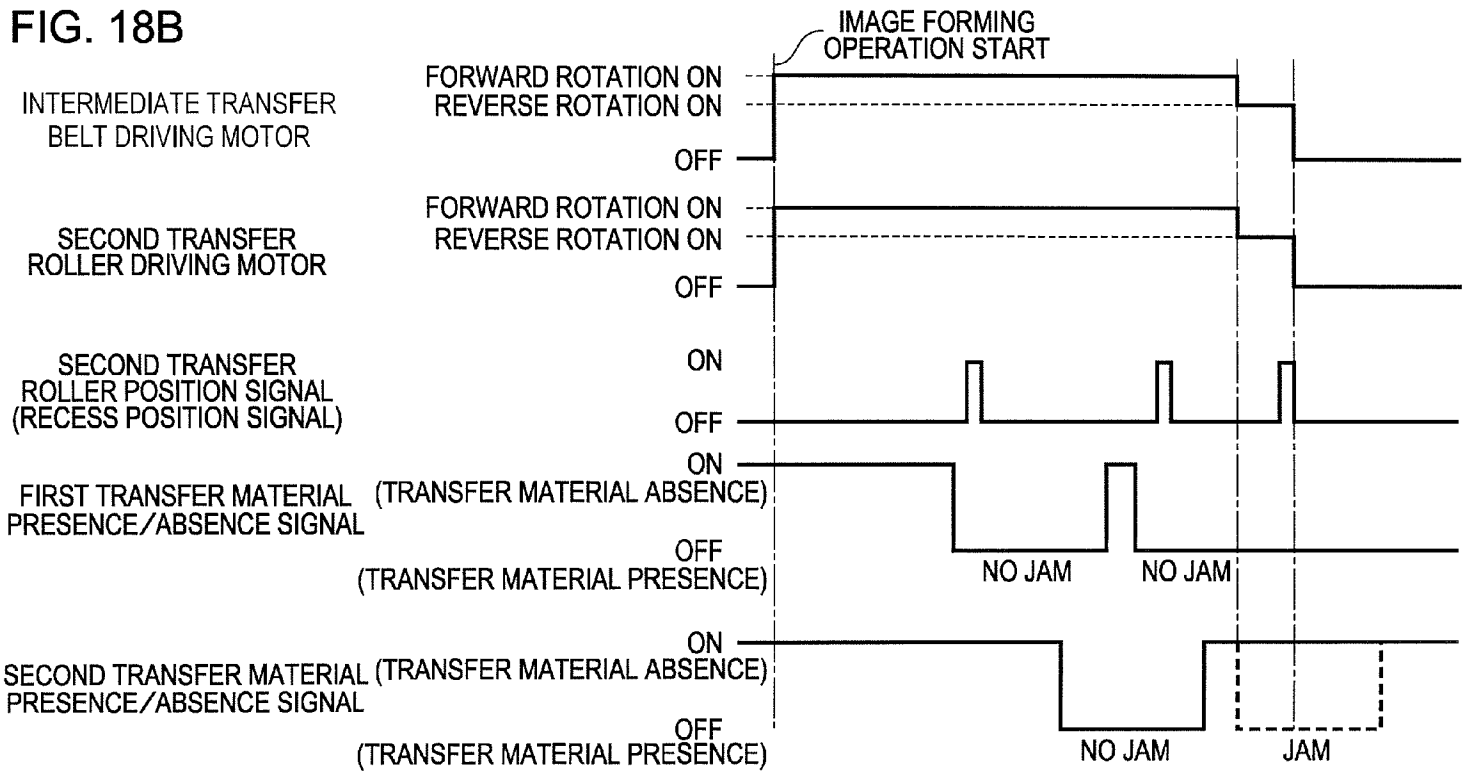
FIG. 18B is an explanatory view showing a signal in the sequence control for each of the intermediate transfer belt driving motor and the second transfer roller driving motor when a second jam of the transfer material occurs.

As shown in FIGS. 18A and 18B, when the image forming signal which sets up the transfer material size is input to the controller 32 when a user operates the operation button, the controller 32 sets the image forming apparatus 1 to the image forming mode. Thus, the image forming apparatus 1 starts normal image forming operation. Then, the intermediate transfer belt driving motor 34 and the second transfer roller driving motor 35 are driven respectively (ON), so that the intermediate transfer belt driving motor 34 rotates in the direction β (forward direction), and the second transfer roller driving motor 35 rotates in the direction γ (forward direction). After the leading edge 19*a* of the transfer material 19 which is transported from the gate roller 18 is pinched by the gripper 15 as described above, the transfer material 19 enters the second transfer nip 11*a*. Also, the toner image transported on the intermediate transfer belt 8 is transferred to the transfer material 19 at the second transfer nip 11*a*.

At this time, the first transfer material presence/absence detector 38 does not detect the transfer material 19, and outputs the first transfer material presence/absence signal (ON signal) until the transfer material 19 which is transported from the gate roller 18 reaches the detection timing position of the first transfer material presence/absence detector 38. When the first transfer material presence/absence detector 38 detects the transfer material 19 as the transfer material 19 reaches the detection timing position of the first transfer material presence/absence detector 38, the first transfer material presence/absence signal from the first transfer material presence/absence detector 38 becomes OFF. In other words, the transfer material 19 does not jam (when the jam does not occur). Further, the second transfer material presence/absence detector 39 does not detect the transfer material 19 and outputs the second transfer material presence/absence signal (ON signal), until the transfer material 19 reaches the detection timing position of the second transfer material presence/absence detector 39. When the transfer material 19 reaches the detection timing position of the second transfer material presence/absence detector 39, so that the second transfer material presence/absence detector 39 detects the transfer material 19, the second transfer material presence/absence signal from the second transfer presence/absence detector 39 becomes OFF. That is to say, the jam of the transfer material 19 does not occur (when the jam does not occur).

If the transfer material 19 from the gate roller 18 is jammed, so that the transfer material 19 does not reach the detection timing position of the first transfer material presence/absence detector 38, the first transfer material presence/absence detector 38 does not detect the transfer material 19 at the detection timing. At this time, the rotation of the second transfer roller 12 is stopped in the state that the elastic member 12*b* does not contact the intermediate transfer belt 8 in the same manner as the fourth embodiment described above.

Further, after the first transfer material presence/absence detector 38 detects the transfer material 19 at the detection timing position, so that the first transfer material presence/absence signal from the first transfer material presence/absence detector 38 becomes OFF, when the jam of the transfer material 19 occurs and the transfer material 19 does not reach the detection timing position of the second transfer material presence/absence detector 39, the second transfer material presence/absence detector 39 does not detect the transfer material 19 at the detection timing position. Therefore, the second transfer material presence/absence signal from the second transfer material presence/absence detector 39 does not become OFF, and the second transfer material presence/absence detector 39 outputs the second transfer material presence/absence signal (ON signal) to the controller 32 continuously (the second transfer material jam occurs). In other words, the jam of the transfer material 19 occurs (when the jam occurs). Then, the controller 32 determines that the second transfer material jam of the transfer material is occurring, and the second transfer roller driving motor 35 rotates in reverse. Namely, if the jam is detected after the second transfer roller 12 rotates forward; the roller 12 is stopped instantly and is then rotated in reverse. Also, at this time, the controller 32 rotates the intermediate transfer belt driving motor 34 in reverse, so that the intermediate transfer belt 8 is also rotated in reverse. After that, each actuation of the second transfer roller driving motor 35 and the intermediate transfer belt driving motor 34 is stopped respectively when the second transfer roller position signal (ON signal) is input initially. Accordingly, the second transfer roller 12 is stopped in the state in which the elastic member 12*b* is not contacted to the intermediate transfer belt 8, when the second transfer material jam of the transfer material 19 occurs.

As described above, when the second transfer material jam of the transfer material 19 occurs, the second transfer roller 12 rotates in reverse until the concaved portion 14 reaches the transfer nip formation area, and it is stopped when the concaved portion 14 reaches the transfer nip formation area. At this time, when the second transfer roller 12 rotates in reverse after the second transfer material jam of the transfer material 19 occurred, the intermediate transfer belt 8 also rotates in reverse. Also, the intermediate transfer belt 8 does not necessarily need to rotate in reverse when the second transfer roller 12 rotates in reverse after the second jam of the transfer material 19 occurs. However, it is preferable to rotate the intermediate transfer belt 8 when the second transfer roller 12 rotates in reverse after the jam of the transfer material 19 is detected to decrease the friction between the second transfer roller 12 and the intermediate transfer belt 8.

According to the image forming apparatus in the fifth embodiment, after the transfer material 19 is detected at the first transfer material presence/absence detector 38, and when the second transfer material jam of the transfer material 19 occurs, the controller 32 controls the second transfer roller 12 so as to rotate in reverse, on the basis of the second transfer roller position signal (ON signal) and the second transfer material presence/absence signal (ON signal) from the second transfer material presence/absence detector 39. Then, the reverse rotation of the second transfer roller 12 is stopped when the concaved portion 14 is located at the transfer nip formation area. Thus, it can suppress the toner which is transported by the intermediate transfer belt 8 that may attach the second transfer roller 12.

In other respects, the constitution and effects of the image forming apparatus in the fifth embodiment are the same as those of the fourth embodiment. In this case, the second transfer material presence/absence detector 39 can be located at any one of the inner side of the endless shaped transfer material transport belt 29*a* of the transfer material transporter 29, the third air flow generator 30, the front side of the image fixing section 31, and the rear side of the image fixing section 31.

Moreover, the image forming apparatus and the image forming method of the invention are not limited to the above described preferred embodiments. For example, in the above described embodiments, the intermediate transfer belt 8 is used as the image carrier, however, the intermediate transfer drum or photo sensor can be used as the image carrier. In the case where a photosensitive body is applied as the image carrier, the toner image of the photosensitive body is directly transferred to the transfer material. Also, the image forming apparatus has 4 colors; however the image forming apparatus may have a single color.

With the image forming apparatus according to the illustrated embodiments, there is provided an image forming apparatus and the image forming method. An elastic member is installed in the circumferential surface of the transfer roller having a concaved portion, along with which a transfer nip formation area is formed where the transfer roller is pressed against the image carrier when the image is transferred. In this case, the width of the concaved portion is larger than the width of the transfer nip formation area in the circumferential direction of the transfer roller. The transfer roller is stopped when the concaved portion is in the transfer nip formation area, so as not to have contact between the transfer roller and the image carrier when the image is not transferred. Thus, the transfer nip is not formed in the transfer nip formation area between the transfer roller and the image carrier when the image forming operation of the image forming apparatus is not performed. Accordingly, the elastic member of the transfer roller is not twisted, even when the image forming apparatus is not operated for a long time. Thus, the image defect and the occurrence of the banding caused by the twisting of the elastic member are suppressed effectively and a higher quality image can be obtained.

In addition, when the rotation of the transfer roller is stopped, the concaved portion is reliably positioned on the transfer nip formation area so that the transfer roller can be reliably stopped in a constant position. Accordingly, the rotational position of the transfer roller can be controlled when the next image forming operation is performed, and the positional alignment between the rotational position of the transfer roller and the transfer material which is transported to the apparatus is easily accomplished.

Additionally, each rotation of the image carrier driver driving the image carrier and the transfer roller driver driving the transfer roller may be controlled independently, so that the rotation velocity of the image carrier driver and the transfer roller driver can be controlled properly and individually.

Also, the elastic member of the transfer roller is not in contact with the image carrier when the image carrier is driven and the transfer roller driver is stopped. In the state in which the elastic member is not in contact with the image carrier, unstable sliding between the elastic member of the transfer roller and the image carrier can be suppressed when the image carrier starts to rotate independently or when the image carrier is stopped after rotating independently.

Also, in the state in which the rotation of the transfer roller is stopped, the image carrier can be rotated in the state that the elastic member of the transfer roller is not in contact with the image carrier by placing the concaved portion in the transfer nip formation area. However, in the case that the transfer roller of the image forming apparatus is always in press-contact with the image carrier, it is necessary for the transfer roller to be separated from the image carrier to change the distance between the rotational axis of the transfer roller and the rotational axis of the image carrier, when the image carrier is cleaned or registration alignment thereof is performed. Meanwhile, the image transfer apparatus of the illustrated embodiments has a transfer roller separating from the image carrier without substantially changing the distance between the rotational axis of the transfer roller and the rotational axis of the image carrier. Thus, the operation as described above can be accomplished with easily and quickly.

In addition, when a jam of the transfer material occurs, the controller stops the rotation of the transfer roller so that the concaved portion is located in the transfer nip formation area, on the basis of the transfer roller position signal and the transfer presence/absence signal from the transfer presence/absence detecting section. Accordingly, it can be suppressed that the toner of the image being carried by the image carrier is attached on the transfer roller. In particular, by setting the location of the transfer material detecting timing position of the transfer material presence/absence detecting section to immediately upstream of the concaved portion detecting position (the position of the concaved portion when the concaved portion is placed in the transfer nip formation area) on the front of the transfer roller position, the toner of the image being carried by the image carrier can be more effectively suppressed from being attached on the transfer roller.

Also, when a jam of the transfer material passing through the transfer nip at the transfer presence/absence detecting section is detected, the controller stops the reverse rotation of the transfer roller when the concaved portion is located on the transfer nip position after reverse rotation of the transfer roller, on the basis of the transfer roller position signals and the transfer material presence/absence signals of the transfer presence/absence detecting section. Accordingly, it can be more effectively suppressed that the toner of the image being carried by the image carrier is attached on the transfer roller.

Also, in the state in which the transfer material is pinched by the transfer material gripper, the transfer material passes through the transfer nip, so that separation of the transfer material from the image carrier can be reliably accomplish after the image is transferred.

Also, the image carrier has an elastic layer, so that the transfer efficiency can be enhanced even though the transfer material has high surface roughness. Even if this image carrier has the elastic layer, the transfer nip is not formed in the case that the image carrier and the transfer roller is stopped for a long time, so that it is possible to suppress the occurrence of twisting occurrence between the elastic layer of the image carrier and the elastic layer of the transfer roller.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming apparatus comprising:

an image carrier configured and arranged to carry an image;

a transfer roller including a substrate and an elastic member, the substrate including a concaved portion formed on a circumferential surface of the substrate with the concaved portion extending continuously along a shaft of the transfer roller from a first side of the shaft to a second side of the shaft and with the concaved portion having a width in a circumferential direction larger than a width of a transfer nip formation area formed between the image carrier and the transfer roller in the circumferential direction, the elastic member disposed on the circumferential surface of the substrate, the transfer roller being configured and arranged to transfer the image which is carried by the image carrier onto a transfer material at the transfer nip formation area;

a transfer roller position detector configured and arranged to detect a rotational position of the transfer roller; and a controller configured to stop rotation of the transfer roller in a state in which the concaved portion is located at the transfer nip formation area on the basis of the rotational position of the transfer roller detected by the transfer roller position detector.

2. The image forming apparatus according to claim 1, further comprising an image carrier driving source configured and arranged to drive the image carrier, and a transfer roller driving source configured and arranged to drive the transfer roller.

3. The image forming apparatus according to claim 2, wherein the controller is configured to control driving of the image carrier in a state in which the transfer roller is stopped.

4. The image forming apparatus according to claim 1, further comprising a transfer material gripper installed in the concaved portion of the transfer roller, and configured and arranged to grip the transfer material.

5. An image forming apparatus comprising:

an image carrier configured and arranged to carry an image;

a transfer roller including a concaved portion formed on a circumferential surface thereof with the concaved portion having a width in a circumferential direction larger than a width of a transfer nip formation area formed between the image carrier and the transfer roller in the circumferential direction, the transfer roller including an elastic member disposed on the circumferential surface thereof, the transfer roller being configured and arranged to transfer the image which is carried by the image carrier onto a transfer material at the transfer nip formation area;

a transfer roller position detector configured and arranged to detect a rotational position of the transfer roller;

a controller configured to stop rotation of the transfer roller in a state in which the concaved portion is located at the transfer nip formation area on the basis of the rotational position of the transfer roller detected by the transfer roller position detector; and a transfer material detector configured and arranged to detect presence or absence of the transfer material to output a signal indicating presence or absence of the transfer material, the controller being configured to stop the rotation of the transfer roller when the concaved portion is located at the transfer nip formation area on the basis of the signal indicating presence or absence of the transfer material output by the transfer material detector.

6. The image forming apparatus according to claim 5, wherein the transfer material detector is located in such a position that the transfer material detector detects presence or absence of the transfer material passing through the transfer nip formation area, and the controller is configured to rotate the transfer roller forward or in reverse on the basis of the signal indicating presence or absence of the transfer material output by the transfer material detector.

7. An image forming apparatus comprising:

an image carrier configured and arranged to carry an image;

a transfer roller including a concaved portion formed on a circumferential surface thereof with the concaved portion having a width in a circumferential direction larger than a width of a transfer nip formation area formed between the image carrier and the transfer roller in the circumferential direction, the transfer roller including an elastic member disposed on the circumferential surface thereof, the transfer roller being configured and arranged to transfer the image which is carried by the image carrier onto a transfer material at the transfer nip formation area; and a transfer roller position detector configured and arranged to detect a rotational position of the transfer roller, the image carrier including an elastic layer.

8. An image forming method comprising:

transferring an image carried by an image carrier onto a transfer material at a transfer nip formation area formed between a transfer roller and the image carrier, with the transfer roller including a substrate and an elastic member, the substrate including a concaved portion formed on a circumferential surface of the substrate with the concaved portion extending continuously along a shaft of the transfer roller from a first side of the shaft to a second side of the shaft, the concaved portion having a width in a circumferential direction of the transfer roller larger than a width of the transfer nip formation area in the circumferential direction, the elastic member being disposed on the circumferential surface of the substrate;

detecting a rotational position of the transfer roller; and stopping rotation of the transfer roller in a state in which the concaved portion is positioned at the transfer nip formation area on the basis of the detected rotational position of the transfer roller.

* * * * *